US008577235B2

(12) United States Patent
Matsumoto et al.

(10) Patent No.: US 8,577,235 B2
(45) Date of Patent: Nov. 5, 2013

(54) IMAGE FORMING APPARATUS FEATURING CONTROL VOLTAGES APPLIED TO MAGNETIC PARTICLE CARRYING MEMBERS

(75) Inventors: Ryota Matsumoto, Yokohama (JP); Yukwi Hong, Hiratsuka (JP); Shingo Horita, Tokyo (JP); Koichi Hashimoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 523 days.

(21) Appl. No.: 12/897,867

(22) Filed: Oct. 5, 2010

(65) Prior Publication Data

US 2011/0081155 A1 Apr. 7, 2011

(30) Foreign Application Priority Data

Oct. 5, 2009 (JP) ..... 2009-231429
Sep. 27, 2010 (JP) ..... 2010-215317

(51) Int. Cl.
*G03G 15/02* (2006.01)

(52) U.S. Cl.
USPC ..... 399/50; 399/175

(58) Field of Classification Search
USPC ..... 399/50, 174–176
See application file for complete search history.

(56) References Cited

U.S. PATENT DOCUMENTS

| | | | | |
|---|---|---|---|---|
| 6,064,837 | A | 5/2000 | Hashimoto et al. | |
| 6,088,548 | A | 7/2000 | Hashimoto et al. | |
| 7,103,303 | B2 * | 9/2006 | Suzuki et al. | 399/175 |
| 7,457,555 | B2 | 11/2008 | Nakamura | |
| 2002/0076239 | A1 * | 6/2002 | Inoue | 399/175 |
| 2008/0050150 | A1 | 2/2008 | Horita et al. | |

FOREIGN PATENT DOCUMENTS

| | | | |
|---|---|---|---|
| JP | 2000098675 A | * | 4/2000 |
| JP | 2004069775 A | * | 3/2004 |

* cited by examiner

*Primary Examiner* — David Gray
*Assistant Examiner* — Laura Roth
(74) *Attorney, Agent, or Firm* — Fitzpatrick, Cella, Harper & Scinto

(57) ABSTRACT

An image forming apparatus includes a rotatable drum, a charging section for charging the drum, a latent image forming section, a potential detector, a phase detector, and a controller. The charging section includes a first carrying member and a second carrying member for carrying electroconductive magnetic particles. The second carrying member is disposed downstream of said first carrying member. The latent image forming section forms a latent image on the drum, and is disposed downstream of the charging section. The potential detector detects a surface potential of the drum, and is disposed downstream of the charging section. The phase detector detects information relating to a rotational phase of the second carrying member. The controller controls voltages applied to the first carrying member and to the second carrying member, on the basis of a result of detection by the potential detector and a result of detection by the phase detector.

4 Claims, 10 Drawing Sheets

(a)

(b)

IMAGE FORMING APPARATUS FEATURING CONTROL VOLTAGES APPLIED TO MAGNETIC PARTICLE CARRYING MEMBERS

FIELD OF THE INVENTION AND RELATED ART

The present invention relates to an image forming apparatus which employs one of electrophotographic image forming methods.

Conventional image forming apparatuses which employ an electrophotographic image forming method have a charging means for uniformly charging the peripheral surface of an image bearing member. As for the changing method employed by the charging means, a charging method of the corona type, a charging method which uses a roller, etc., have been known. A charging method of the corona type is such a charging method that utilizes electrical discharge. These charging methods, however, result in the formation of unwanted products attributable to electrical discharge. Thus, it is possible that electrophotographic image forming apparatuses which employ any of the charging methods of the above-mentioned types sometimes yield images of lower quality. On the other hand, there are image forming methods which do not rely on electrical discharge. These methods charge an image bearing member by directly injecting electric charge into the surface layer of the image bearing member, and therefore, are referred to as charging methods of the injection type, or injection charging methods. Since the charging methods of the injection type do not use electrical discharge, they do not produce substances attributable to electrical discharge. Thus, image forming apparatuses which employ a charging method of the injection type are unlikely to yield images of lower quality, the low quality of which is attributable to the products which result from the electrical discharge:

However, image forming apparatuses which employ any of the charging methods of the injection type have the following problems.

An image forming apparatus which employs a charging method of the injection type is structured so that its charging means directly contacts the surface of its image bearing member(s). Thus, unless the state of contact between the charging means and the peripheral surface of the image bearing member remains stable, the peripheral surface of the image bearing member is nonuniformly charged. As one of the means for dealing with this problem of a charging method of the injection type, that is, the means for preventing the peripheral surface of an image bearing member from being nonuniformly charged, various structural arrangements have been proposed for an electrophotographic image forming apparatus which employs a charging method of the injection type.

For example, it is possible to provide an electrophotographic image forming apparatus with multiple magnetic particle bearing members (means for bearing magnetic particles) to minimize the amount of the deviation in the potential level to which the surface of the image bearing member is charged. Obviously, an electrophotographic image forming apparatus having multiple magnetic particle bearing members can more uniformly charge its image bearing member(s) than an electrophotographic image forming apparatus having only one charging means. However, it still suffers from the problem that the potential level to which its image bearing member is charged is affected by the most downstream magnetic particle bearing member in terms of the moving direction of the peripheral surface of the image bearing member. There is also another problem. That is, as the magnetic particle bearing members increase in the cumulative length of time they are used for charging an image bearing member, the magnetic particles on the magnetic particle bearing member gradually increase in electrical resistance, which in turn increases the amount of the deviation in the potential level to which the peripheral surface of the image bearing member is charged.

There has been disclosed in U.S. Pat. No. 7,457,555, another art for minimizing the amount of the deviation in the potential level to which the surface of the image bearing member of an electrophotographic image forming apparatus is charged. According to this patent, an electrophotographic image forming apparatus is provided with multiple magnetic particle bearing members, which are sequentially arranged in the adjacencies of the peripheral surface of the image bearing member, in the direction parallel to the moving direction of the peripheral surface of the image bearing member, and the voltage to be applied to these magnetic particle bearing members are controlled. More specifically, the voltages to be applied to the multiple magnetic particle bearing members, one for one, are controlled so that the amount by which electric current flows from the most downstream magnetic particle bearing member to the surface of the image bearing member becomes no more than 25% relative to the total amount by which electric current flows from the multiple magnetic particle bearing members to the surface of the image bearing member.

However, with the use of the above-described voltage controlling method, it is rather difficult to reliably minimize the amount of the deviation in the potential level to which the peripheral surface of the image bearing member of the apparatus is charged. In other words, it cannot be said that the above-described voltage controlling method optimizes the voltage to be applied to charge the surface of the image bearing member. It is possible to vary in steps the voltage to be applied to each of the magnetic particle bearing members to find the voltage value that minimizes the charging means in the amount of deviation in the potential level to which an image bearing member is charged. This method however cannot be said to be effective, because each time the voltage to be applied to the magnetic particle bearing members are varied in value, the image forming apparatus has to be idled. Moreover, it is possible that while the voltage to be applied to the magnetic particle bearing members is changed in steps in value, an improper voltage is applied. If an improper voltage is applied to the magnetic particle bearing members, it is possible that the magnetic particles adhere to the surface of the image bearing member and/or the surface of the image bearing member is damaged by an excessive amount of voltage.

SUMMARY OF THE INVENTION

Thus, the primary object of the present invention is to provide an image forming apparatus which employs multiple magnetic particle bearing members, and yet, efficiently minimizes the amount of the deviation in the potential level to which the surface of its image bearing member is charged, by optimally controlling the voltage to be applied to the magnetic particle bearing members.

According to an aspect of the present invention, there is provided an image forming apparatus comprising a rotatable image bearing member; charging means for charging said image bearing member, said charging means including a first magnetic particle carrying member for carrying electroconductive magnetic particles and a second magnetic particle carrying member for carrying the magnetic particles, said second magnetic particle carrying member being disposed at a downstreammost position with respect to a rotational direction of said image bearing member, wherein said magnetic particle is in contact with said image bearing member while charging said image bearing member; latent image forming means, disposed at a position downstream of said charging means with respect to the rotational direction of said image bearing member, for forming a latent image on said image bearing member; potential detecting means for detecting a surface potential of said image bearing member, said potential detecting means being disposed downstream of said charging means and upstream of said latent image forming means with respect to the rotational direction of said image bearing member; phase detecting means for detecting information relates to a rotational phase of said second magnetic particle carrying member; control means for controlling voltages applied to said first magnetic particle carrying member and to said second magnetic particle carrying member; and wherein said control means is capable of executing an operation in a control mode for controlling the voltages applied to said first magnetic particle carrying member and to said second magnetic particle carrying member, on the basis of a result of detection by said potential detecting means and a result of detection by said phase detecting means.

The present invention can provide an image forming apparatus which has multiple magnetic particle bearing members, and uniformly and efficiently charges its magnetic particle bearing member by properly controlling the voltage to be applied to the magnetic particle bearing members.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings. Incidentally, the measurements, materials, and shapes of the various structural components of the image forming apparatuses, and the positional relationship among the components, in the following preferred embodiments of the present invention, are not intended to limit the present invention in scope, unless specifically noted.

Embodiment 1

1-1: General Structure of Image Forming Apparatus

Figure 1:
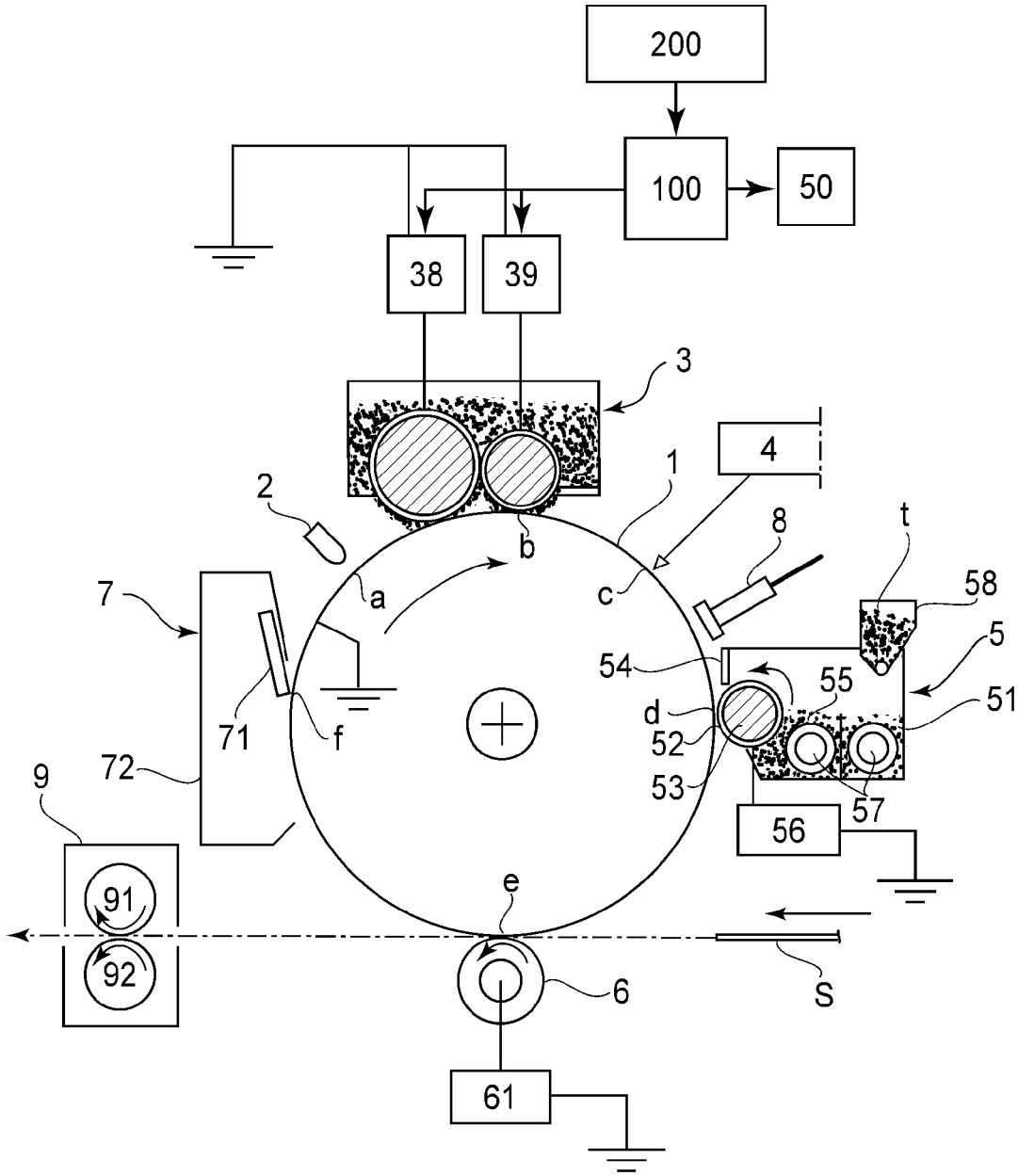
FIG. 1 is a schematic sectional view of the image forming apparatus in the first preferred embodiment of the present invention, and depicts the general structure of the apparatus.

First, referring to FIG. 1, the general structure of the image forming apparatus in the first preferred embodiment of the present invention is described. The image forming apparatus in this embodiment is an electrophotographic image forming apparatus. It employs a magnetic brush as a charging means, develops an electrostatic latent image in reverse, and is of the transfer type. As examples of an image forming apparatus similar to the image forming apparatus in this embodiment, there are electrophotographic copying machines, electrophotographic printers, facsimileing machines, word processors, apparatuses capable of performing two or more functions of the preceding apparatuses, etc.

The image forming apparatus in this embodiment has an electrophotographic photosensitive member 1 (which hereafter will be referred to simply as photosensitive drum 1), which is a rotatable image bearing member. The photosensitive drum 1 is in the form of a drum. The operation carried out by this image forming apparatus is to form an image on a sheet of recording medium S (which hereafter will be referred to simply as recording sheet S) as follows: First, the information of the image to be formed is inputted into the controlling apparatus 100 (controlling means) of the image forming apparatus from a host apparatus 200, such as an image reader, a personal computer, a facsimileing apparatus, etc. Then, a toner image which reflects the inputted information of the image to be formed is formed on the peripheral surface of the photosensitive drum 1. Then, the toner image on the peripheral surface of the photosensitive drum 1 is transferred onto the recording sheet S, such as a sheet of paper, a piece of OHP sheet, or the like. Then, the recording sheet S is introduced into the fixing apparatus 9 of the image forming apparatus, in which the unfixed toner image on the recording sheet S is fixed to the surface of the recording sheet S. The controlling apparatus 100 exchanges with the host apparatus 200, various information which is in the form of electrical signals, and also, integrally controls the image formation processes to be carried out by the apparatus, according to the control programs and referential tables. Next, the various members which are related to the various image formation processes are described in more detail.

The photosensitive drum 1 is rotatably supported by its axle, and is rotated by a driving apparatus 50 (driving means, which is turned on or off by controlling apparatus 100) in the clockwise direction, that is, the direction indicated by an arrow mark in the drawing, at a preset peripheral velocity (surface movement speed). In this embodiment, the photosensitive drum 1 is rotated at a peripheral velocity of 300 mm/sec.

Figure 2:
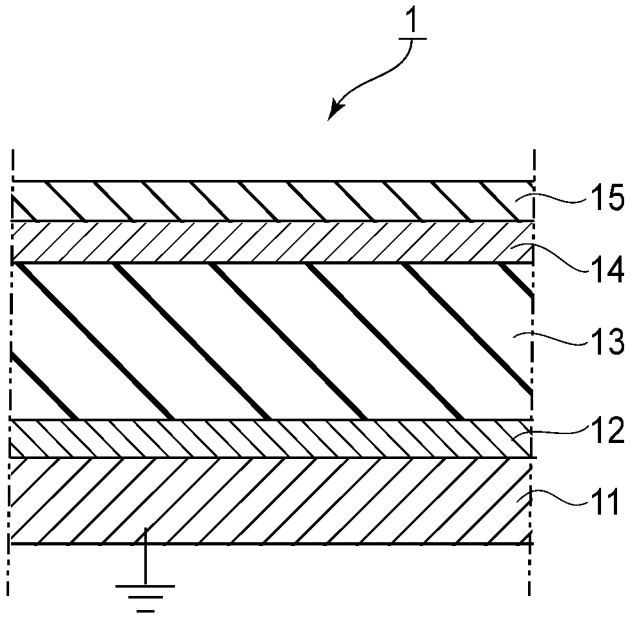
FIG. 2 is a schematic vertical sectional view of the surface layers of the image bearing member in the first embodiment of the present invention, and depicts the laminar structure of the image bearing member.

FIG. 2 shows the laminar structure of the photosensitive drum 1 in this embodiment. The photosensitive drum 1 in this embodiment is a photosensitive member of the amorphous silicon type (a-Si type), and is negatively charged. More concretely, it is made up of an aluminum (Al) drum 11 and four functional layers. The aluminum drum 11 serves as an electrically conductive substrate layer. The peripheral surface of the drum 11 is covered with a positive charge blocking layer 12, which prevents positive holes from flowing into the upper layers of the photosensitive drum 1. The positive charge blocking layer 12 is covered with a photoconductive layer 13, through which photo-carrier generated by exposure flows. The photoconductive layer 13 is covered with a negative charge blocking layer 14, which prevents the electrons given by charging process from moving inward of the photosensitive drum 1. Further, the negative charge blocking layer 14 is covered with a surface protection layer 15, which protect the photosensitive layers from the friction and pressure attributable to various drum processing means.

The image forming apparatus has various processing means which form a toner image on the peripheral surface of the photosensitive drum 1, and a transferring means which transfers the toner image from the peripheral surface of the photosensitive drum 1 onto the recording sheet S. These means are in the adjacencies of the peripheral surface of the photosensitive drum 1. The drum processing means are a preparatory exposure lamp 2, a charging apparatus 3 of the magnetic brush type, a laser scanner 4, a developing apparatus 5, a transfer roller 6, a cleaning device 7, etc. These processing means are in the adjacencies of the peripheral surface of the photosensitive drum 1, and are in the listed order in terms of the rotational direction of the photosensitive drum 1.

The operation for forming an image on the recording sheet S with the use of the image forming apparatus structured as described above is as follows: First, the photosensitive drum 1 is rotated, and then, electric charge is removed from the peripheral surface of the rotating photosensitive drum 1 by a preparatory exposure lamp 2 (eraser lamp as charge removing means), at a charge removal point a. The preparatory exposure lamp 2 is a means for erasing the electrical memory remaining on the peripheral surface of the photosensitive drum 1 because of the preceding image forming operation. The preparatory exposure lamp in this embodiment has an LED which is 600 nm in wavelength, and exposes the entirety of the peripheral surface of the photosensitive drum 1 with roughly 370 Lux.sec. of light.

Then, the peripheral surface of the photosensitive drum 1, from which electrical charge has just been removed by the preparatory exposure 2, is uniformly charged to preset polarity and potential level by the charging apparatus 3 (as charging means) which uses a magnetic brush. The structure of this charging apparatus 3 which uses a magnetic brush will be described later.

Next, the portion of the peripheral surface of the photosensitive drum 1, which has just been charged by the charging apparatus 3 of the magnetic brush type, is exposed by the laser scanner 4, which is an exposing means (latent image forming means), at a latent image formation point c, whereby an electrostatic latent image, which reflects the exposure pattern, is formed on the peripheral surface of the photosensitive drum 1 as if it emerges from the latent image formation point c. The laser scanner 4 scans (exposes) the charged portion of the peripheral surface of the photosensitive drum 1 with a beam of laser light which it outputs in response to the image formation signals inputted from the controlling apparatus 100. As the charged portion of the peripheral surface of the photosensitive drum 1 is exposed by the laser scanner 4, an electrostatic latent image, which reflects the image formation signals (information of image to be formed) is formed on the peripheral surface of the photosensitive drum 1. Incidentally, the structure of the exposing means does not need to be limited to the above-described one. That is, instead of the laser scanner 4 described above, any of the other digital exposing apparatuses, for example, an apparatus which uses an LED array, an exposing apparatus which uses a combination of a light source and a liquid crystal shutter, etc., may be used. Further, an analog exposing apparatus which projects an optical image of an original (image to be formed) upon the charged portion of the peripheral surface of the photosensitive drum 1 through a slit by an optical system may be used instead of the laser scanner 4.

After the formation of the electrostatic latent image on the peripheral surface of the photosensitive drum 1, the electrostatic latent image is developed by the developing apparatus 5 (developing means) into a visible image, that is, an image formed of toner (which hereafter will be referred to simply as toner image) at a development point d. The developing apparatus 5 is such a developing apparatus that develops the electrostatic latent image in reverse with the use of two-component developer 55 (mixture of negatively chargeable toner particles and positively chargeable magnetic particles. Incidentally, designated by a referential code 51 in FIG. 1 is a developer container which stores the developer 55, and designated by a referential code 52 in FIG. 2 is a nonmagnetic development sleeve which functions as a developer bearing member. The development sleeve 52 is rotatable, and is in the developer container 51, with its peripheral surface being partially exposed from the developer container 51. It is rotated in the counterclockwise direction at a preset peripheral velocity. As the development sleeve 52 is rotated, the two-component developer 55 is adhered to the portion of the peripheral surface of the development sleeve 52, which came into contact with the two-component developer 55, by the magnetic force of the magnetic roller 53 in the development sleeve 52, and forms a two-component toner layer as the magnetic brush. Then, as the development sleeve 52 is rotated further, the developer layer on the peripheral surface of the development sleeve 52 is formed by a blade 54 into a thinner layer of toner which is preset in thickness. The position of the development sleeve 52 in the developer container 51 is such that a preset amount of gap is maintained between the peripheral surface of the photosensitive drum 1 and that of the development sleeve 52. The point at which the distance between the photosensitive drum 1 and development sleeve 52 is smallest is the development point d.

At the development point d, the developer on the peripheral surface of the development sleeve 52 is supplied to the electrostatic latent image on the peripheral surface of the photosensitive drum 1 as follows: a preset development voltage is applied to the development sleeve 52 from the electric power source 56 for development voltage application. The peripheral surface of the rotating development sleeve 52 is coated with a thin layer of the developer as described above, and the thin layer of the developer is conveyed to the development point d by the further rotation of the development sleeve 52. At the development point d, the toner particles in the thin layer of developer on the peripheral surface of the development sleeve 52 are adhered by the electric field generated by the development voltage, to specific points of the electrostatic latent image on the peripheral surface of the photosensitive drum 1, developing thereby the latent image in reverse into a toner image.

In this embodiment, in order to keep the two-component developer 55 in the developer container 51 roughly within a preset range in terms of toner density, the toner density of the two-component developer 55 in the developer container 51 is detected by an optical toner density sensor (unshown). Based on the information of the detected toner density, the controlling apparatus 100 drives the toner supply roller of the toner hopper 58 to supply the toner t in the toner hopper to the two-component developer in the developer container 51. As the toner t is supplied to the two-component developer 55 in the developer container 51, it is stirred along with the two-component developer 55 in the developer container 51 so that it is uniformly dispersed in the two-component developer 55.

The image forming apparatus is provided with a sheet conveying mechanism (unshown), which stores multiple recording sheets S and feeds one by one the recording sheets S into the main assembly of the image forming apparatus, with such a timing that each recording sheet S is delivered to the transfer point e, that is, the point of contact between the photosensitive drum 1 and the electrically conductive transfer roller 6 (transferring means). To the transfer roller 6, a transfer voltage which is preset in potential level and is opposite in polarity to the polarity of the toner, is applied from the electric power source 61 for transfer voltage application, with a preset timing, whereby the toner image on the peripheral surface of the photosensitive drum 1 is transferred onto the surface of the recording sheet S, as if it is peeled away from the peripheral surface of the photosensitive drum 1, while the recording sheet S is conveyed through the transfer point e.

After being conveyed through the transfer point e, the recording sheet S is separated from the peripheral surface of the photosensitive drum 1, and is introduced into the fixing apparatus 9. In the fixing apparatus 9, the recording sheet S and the toner image thereon are subjected to heat and pressure, whereby the toner image is fixed to the surface of the recording sheet S. Then, the recording sheet S on which the fixed toner image is present is discharged as a finished copy from the image forming apparatus. The fixing apparatus 9, that is, the fixing apparatus in this embodiment, is a thermal fixing apparatus. It is made up of primarily a pair of rollers, more specifically, a heat roller 91, the temperature of which is kept at a preset level (fixation level), and an elastic pressure roller 92.

After the separation of the recording sheet S from the peripheral surface of the photosensitive drum 1, the peripheral surface of the photosensitive drum 1 is processed by the cleaning device 7. That is, the substances, such as toner particles, remaining on the peripheral surface of the peripheral surface of the photosensitive drum 1 after the separation of the recording sheet S from the peripheral surface of the photosensitive drum 1 are removed at the cleaning point f, so that the peripheral surface of the photosensitive drum 1 can be repeatedly used for image formation. The cleaning device 7 has a urethane cleaning blade 71 (cleaning member) which is 2 mm in thickness. It cleans the peripheral surface of the photosensitive drum 1 by being placed in contact with the peripheral surface of the photosensitive drum 1 at such an angle that its cleaning edge is on the upstream side of its base portion in terms of the moving direction of the peripheral surface of the photosensitive drum 1. Incidentally, after the toner particles, etc., on the peripheral surface of the photosensitive drum 1 are scraped down by the cleaning blade 71, they are stored in the housing 72 (container) of the cleaning device 71.

1-2: Structure of Charging Apparatus of Magnetic Brush Type

Figure 3:
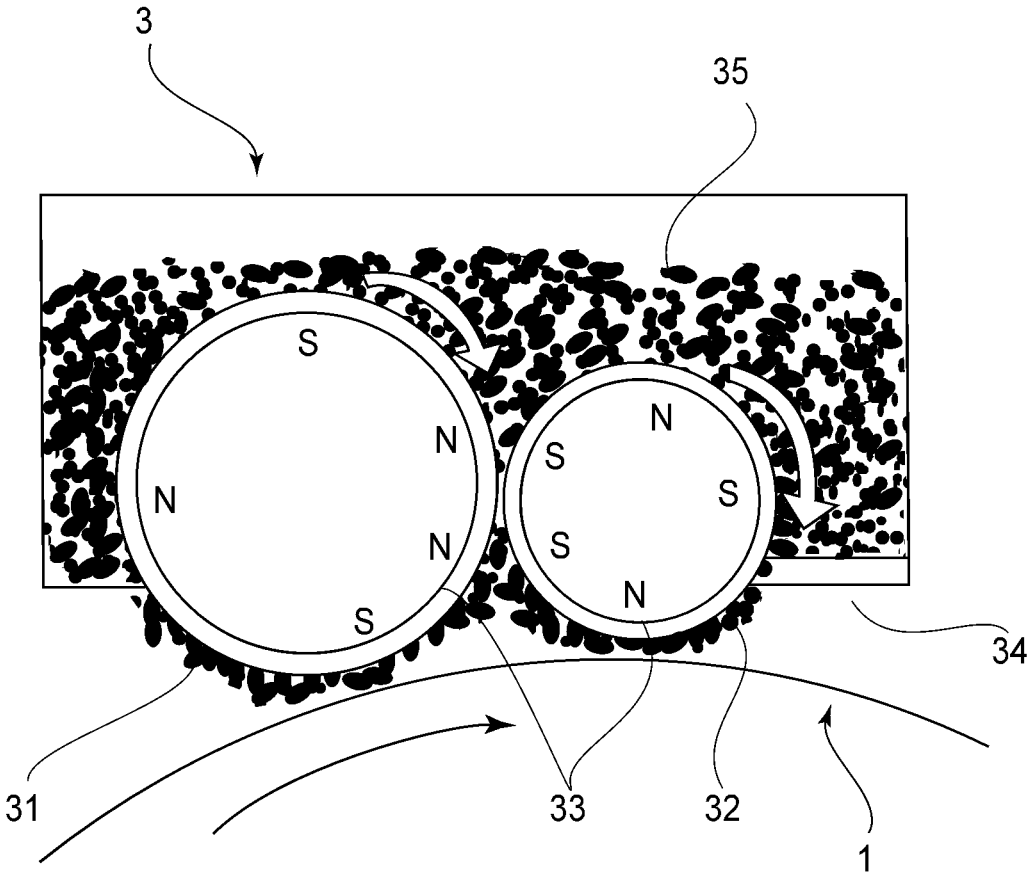
FIG. 3 is the charging means in the first embodiment of the present invention, and depicts the general structure of the charging means.

Next, referring to FIG. 3, the structure of the charging apparatus 3 of the magnetic brush type in this embodiment is described. The charging device 3 of the magnetic brush type has two rotatable charging sleeves 31 and 32 (magnetic particle bearing members), by the peripheral surface of which electrically conductive magnetic particles are borne. The two charging sleeves 31 and 32 are nonmagnetic, and hold stationary magnets 33 in their hollow, one for one. They are rotated in such a direction that the movement of the peripheral surface of each sleeve is opposite to the movement of the peripheral surface of the photosensitive drum 1, in the interface between the two sleeves 31 and 32, and the photosensitive drum 1. The charging sleeves 31 and 32 are in connection to electric power sources 38 and 39 (voltage applying means) for applying charging voltages (charge biases) to the charging sleeves 31 and 32, respectively (FIG. 1). In this embodiment, it is a combination of a DC voltage and an AC voltage, and is applied to the charging sleeves 31 and 32 from the electrical power sources 38 and 39, respectively. The electric power sources 38 and 39 are structured so that the voltages to be applied to the charging sleeves 31 and 32 can individually be controlled by the controlling apparatus 100 which will be described later (control sequence itself also will be described later).

With provision of the above-described setup, the magnetic particles 35 are collected on the peripheral surface of the charging sleeve 31, and the peripheral surface of the charging sleeve 32. Then, the collection of the magnetic particles 35 on the peripheral surface of the charging sleeve 32 is regulated by the magnetic particle regulating blade 34, whereby the collection of the magnetic particles is formed into a uniform layer of magnetic particles (magnetic brush). As the charging sleeve 31 is further rotated, the uniform layer of magnetic particles 35 (magnetic brush) comes into contact with the peripheral surface of the photosensitive drum 1, supplying the peripheral surface of the photosensitive drum 1 with electric charge. That is, it is possible to charge the peripheral surface of the photosensitive drum 1 to a voltage level which is close to the level of the charging voltage applied to the charging sleeves 31 and 32.

In this embodiment, the two charging sleeves 31 and 32 are positioned side by side in terms of the rotational direction of the photosensitive drum 1. Hereafter, therefore, the charging sleeve 31, which is on the upstream side in terms of the rotational direction of the photosensitive drum 1, may be referred to as "upstream charging sleeve 31 (magnetic particle bearing first member)", whereas the charging sleeve 32, which is most downstream in terms of the rotational direction of the photosensitive drum 1, may be referred to as "downstream charging sleeve 32 (magnetic particle bearing second member)". Incidentally, "most downstream in terms of rotational direction of the photosensitive drum 1" means the most downstream in relation to the photosensitive member exposing point c. In other words, the charging sleeve 32, which is on the immediately upstream side of the laser scanner 4, is referred to as the "most downstream charging sleeve in terms of the rotational direction of the photosensitive drum 1".

In this embodiment, the peripheral velocity of the photosensitive drum 1 is 300 mm/sec. The peripheral velocities of the upstream charging sleeve 31 and downstream charging sleeve 32 are both 200 mm/sec. That is, the relative peripheral velocity between the photosensitive drum 1 and upstream charging sleeve 31, and the relative peripheral velocity between the photosensitive drum 1 and downstream charging sleeve 32, are both 500 mm/sec.

As the magnetic particles on the peripheral surface of the upstream charging sleeve 31, and the magnetic particles on the peripheral surface of the downstream charging sleeve 32, are moved into the range in which the two magnetic poles, which are the same in polarity, are next to each other, they sometimes separate from the peripheral surface of the corresponding charging sleeve. In this embodiment, therefore, the image forming apparatus is devised in the positioning of its components in such a manner that the stationary magnets 33 in the upstream and downstream charging sleeves 31 and 32 are positioned in such a manner in terms of the rotational directions of the two charging sleeves 31 and 32 that the ranges in which the two magnetic poles which are the same in polarity are next to each other are located as shown in FIG. 3 so that as the magnetic particles 35 move with the peripheral surface of the downstream charging sleeve 32, they transfer onto the peripheral surface of the upstream charging sleeve 31 instead of moving between the charging sleeves 31 and 32.

Further, the stationary magnets 33 in the upstream and downstream charging sleeves 31 and 32, respectively, were adjusted in magnetic flux density so that they became roughly 900 gauss in the magnetic flux density, on the photosensitive drum side. The reason for this adjustment is that if the stationary magnets 33 are no more than 500 gauss in the magnetic flux density on the photosensitive drum side, the so-called "carrier adhesion", that is, a phenomenon that the magnetic particles 35 escape from the magnetic particle confining force of the stationary magnets 33, and adhere to the peripheral surface of the photosensitive drum 1, occurs. Thus, it is desired that the stationary magnets 33 are no less than 700 gauss in magnetic flux density, on the photosensitive drum side. On the other hand, if they are no less than 1,300 gauss in the magnetic flux density on the photosensitive drum side, the problem that the friction between the magnetic particles 35 and the peripheral surface of the photosensitive drum 1 is large enough for the magnetic particles 35 to excessively wear the protective surface layer of the photosensitive drum 1 occurs. Thus, the stationary magnets 33 are desired to be no more than 1,100 gauss in the magnetic flux density on the photosensitive drum side.

The upstream charging sleeve 31 and downstream charging sleeve 32 are 24 mm and 16 mm, respectively, in diameter. The gap between the two charging sleeves 31 and 32 is roughly 300 μm. The gap between the downstream charging sleeve 32 and magnetic particle regulating nonmagnetic blade 34 is roughly 350 μm. The amount of the magnetic particles 35 in the charging means container is 50 g.

The magnetic particles 35 are desired to be 10-100 μm in average diameter, 20-250 emμ/cm$^3$ in saturation magnetization, and $10^2$-$10^{10}$ Ω·cm in electrical resistance. To mention more about the electrical resistance of the magnetic particles 35, it is generally reasonable to think that in order to improve a charging device in performance (easiness with which it can charge peripheral surface of photosensitive drum 1), the magnetic particles for the charging device should be as low as possible in electrical resistance. However, in consideration of the dielectric strength (withstand voltage) of the photosensitive drum 1, the current concentration which occurs as the photosensitive layer (film) is destroyed by the concussional scars or the like, and the like phenomena, the magnetic particles for the charging device are desired to be no less than $10^6$ Ω·cm in electrical resistance. In this embodiment, magnetic particles produced by surface-oxidizing ferrite particles, adjusting them in electrical resistance by reduction, and subjecting them to coupling, are used as the magnetic particles 35. They are 200 emμ/cm$^3$ in saturation magnetization, and $5\times10^6$ Ω·cm in electrical resistance. Incidentally, the above-mentioned electrical resistance of the magnetic particles 35 was measured by placing 2 g of the magnetic particles in a metallic cell which is 223 cm$^2$ in bottom size, and applying 6.6 kg/cm$^2$ of pressure, and 100 V of voltage.

Next, the voltages applied to the upstream and downstream charging sleeves 31 and 32 to charge the peripheral surface of the photosensitive drum 1 is described. The initial voltage applied to the upstream charging sleeve 31 by the electric power source 38 to charge the peripheral surface of the photosensitive drum 1 is a combination of DC voltage which is −800 V, and an AC voltage which is rectangular in waveform, 300 V in peak-to-peak voltage, and 1 kHz in frequency. The initial voltage applied to the downstream charging sleeve 32 by the electric power source 39 to charge the peripheral surface of the photosensitive drum 1 is also a combination of a DC voltage which is −600 V, and an AC voltage which is rectangular in waveform, 300 V in peak-to-peak voltage, and 1 kHz in frequency. However, these voltages may be altered as necessary with the use of the controlling apparatus 100.

1-3: Mechanism of Occurrence of Nonuniform Charging of Photosensitive Drum

Next, the mechanism of the occurrence of the nonuniform charging of the peripheral surface of the photosensitive drum 1 is further described.

<Nonuniformity in Photosensitive Drum Charge Attributable to Downstream Charging Sleeve>

The inventors of the present invention charged the peripheral surface of the photosensitive drum 1 using a charging apparatus of the magnetic brush type, which is virtually the same in structure to the charging apparatus shown in FIG. 3, and analyzed the levels of nonuniformity in potential level at which the peripheral surface of the photosensitive drum 1 was charged. The results of the analysis revealed that the primary contributor to the nonuniformity in potential level of the peripheral surface of the photosensitive drum 1 was the rotational phase of the downstream charging sleeve. They revealed also that the nonuniformity of this type in potential level is characterized in that it is affected neither by the charging means type nor magnetic particle type. That is, in the case of an image forming apparatus structured so that multiple charging apparatuses of the magnetic brush type are aligned in the rotational direction of the photosensitive drum, the nonuniformity in the potential level of the peripheral surface of the photosensitive drum, which is attributable to the changes in the performance of the most downstream charging sleeve, is the largest. There are two reasons why the nonuniformity in the potential level of the peripheral surface of a photosensitive drum, which is attributable to the eccentricity of the photosensitive drum 1, is relatively small. One is that a photosensitive drum is relatively large in diameter compared to a charging sleeve, and therefore, is smaller in the amount of eccentricity. The other is that a given point of the peripheral surface of a photosensitive drum is charged twice, and therefore, the effects of the eccentricity of the photosensitive drum are relatively small compared to those of the most downstream charging sleeve. The reason why the effect of the upstream charging sleeve upon the level of nonuniformity in potential level to which the peripheral surface of a photosensitive drum is relative small compared to that of the most upstream charging sleeve is also that a given point of the peripheral surface of the photosensitive drum is charged twice; a given point of the peripheral surface of the photosensitive drum charged first by the upstream charging sleeve, and then, is charged by the most downstream charging sleeve.

Thus, the present invention is characterized in that the voltage applied to the charging sleeves are controlled to minimize the effect of the most downstream charging sleeve in terms of the rotational direction of the photosensitive drum, upon the potential level to which the peripheral surface of the photosensitive drum is charged. That is, in order to minimize the changes in the performance of the downstream charging sleeve upon the potential level to which the peripheral surface of the photosensitive drum is charged, the voltage to be applied to the upstream charging sleeve 31 to charge the peripheral surface of the photosensitive drum, and the voltage to be applied to the downstream charging sleeve 32 to charge the peripheral surface of the photosensitive drum, are individually controlled. Next, the mechanism of the occurrence of the nonuniform charging of the peripheral surface of a photosensitive drum is described in more detail.

<Nonuniform Charging of Photosensitive Drum in Image Forming Apparatus Having Single Charging Sleeve>

First, the case in which the peripheral surface of the photosensitive drum 1 is nonuniformly charged by a charging apparatus of the magnetic brush type, which has only a single charging sleeve is described. It has been known that the pattern in which the peripheral surface of the photosensitive drum 1 is nonuniformly charged is cyclical, and also, that the cyclical pattern roughly corresponds to the rotational cycle of the charging sleeve. Thus, the inventors of the present invention assumed that the cause of the nonuniform charging of the peripheral surface of the photosensitive drum 1 is attributable to the changes which occur in the distance (which hereafter may be referred to as "SD distance") between the charging sleeve, that is, the bearer of magnetic particles, and the photosensitive drum 1, and which corresponds to the rotational phase of the charging sleeve. Hence, in order to verify this assumption, the inventors of the present invention examined the relationship between the fluctuation in the SD distance and the changes in the potential level to which the peripheral surface of the photosensitive drum 1 is charged, by measuring the changes (μm) in the SD distance.

<Method for Measuring Changes in SD Distance, and Rotational Phase of Charging Sleeve>

Figure 4:
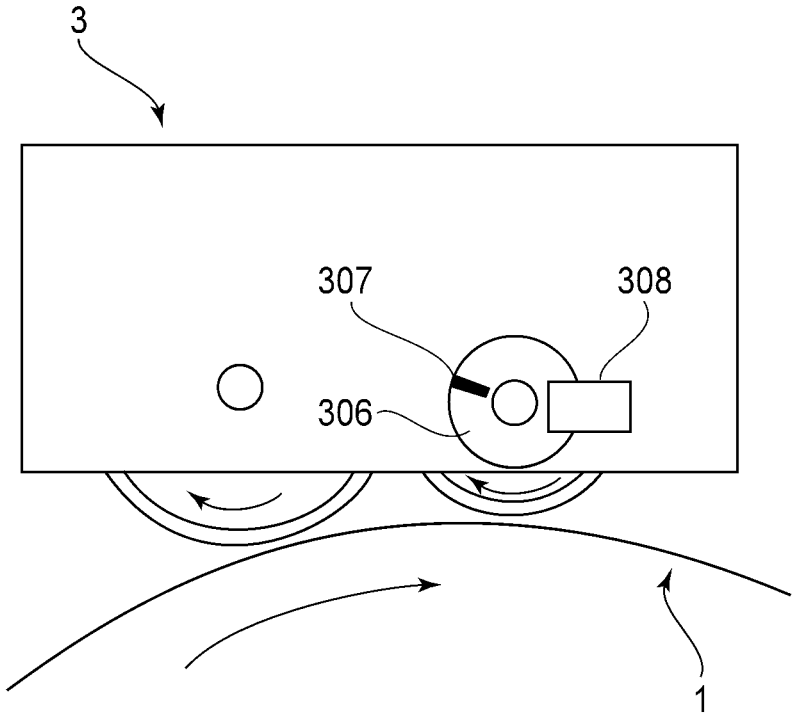
FIG. 4 is a schematic drawing of the phase detecting means in the first embodiment, and depicts the general structure of the detecting means.

The fluctuation in the SD distance were obtained by rotating the charging sleeve in 30 degree steps, and measuring the SD distance with the use of a gap gauge. Further, the image forming apparatus and its charging apparatus were devised so that the rotational phase of the charging sleeve can be measured with reference to a given point on the peripheral surface of the charging sleeve. With this structural arrangement, it was possible to determine what point of the charging sleeve was charging the peripheral surface of the photosensitive drum 1 at a given point in time. That is, it was possible to measure the amount of the positional changes caused to a given point of the peripheral surface of the charging sleeve by the rotation of the charging sleeve. FIG. 4 is a schematic sectional view of the apparatus used for the above-mentioned measurement, and depicts the general structure of the apparatus.

First, a white ring 306, such as the one depicted in FIG. 4, was attached to the extension of the rotational axle of the charging sleeve. Further, a black line 307 was drawn on the white ring 306, from the point of the peripheral surface of the white ring 306, which corresponds to the largest SD distance, toward the center of the white ring 306. Further, a reflective photosensor 308 was attached to the apparatus so that it faces the white ring 306. The reflective photosensor 308 is a combination of a light emitting element and a light sensing element, and a case in which the two elements are positioned. The reflection of the light emitted by the light emitting element is sensed by the light sensing element. The reflective photosensor 308 is structured so that as a change occurs to the amount of the light which is being received by the light sensing element, the output signal from the reflective photosensor 308 also changes.

Figure 5:
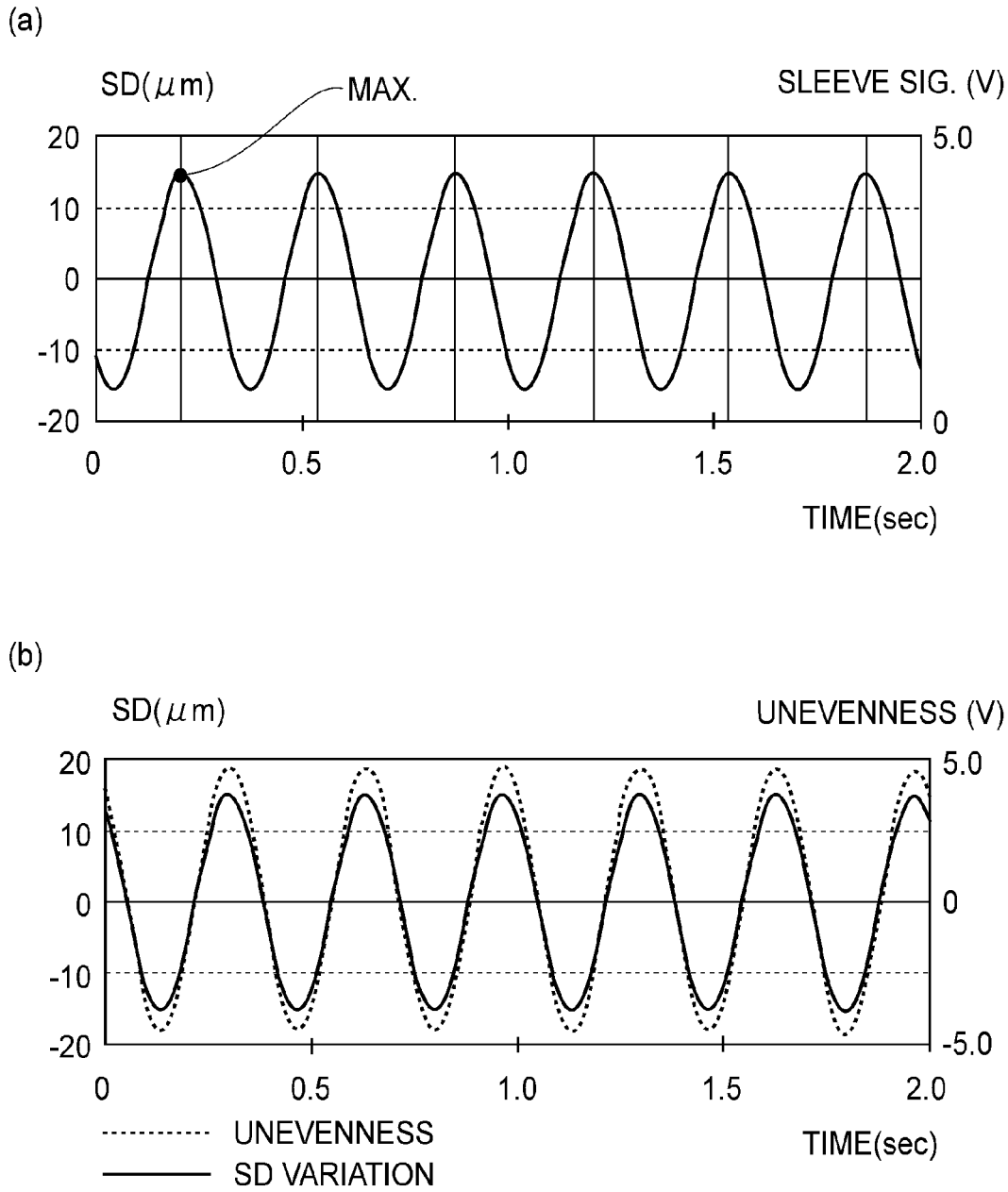
FIGS. 5(*a*) and 5(*b*) are graphs which show the relationship between the SC distance and the amount of the deviation in the potential level.

In this embodiment, the charging apparatus is structured so that as the black line 307 moves across the sensor 308, an electric signal, which is 5 V in value, is outputted from the sensor 308. The black line 307 is positioned on the white ring 306 so that its position coincides with the point of the peripheral surface of the white ring 306, which makes the SD distance largest, as described above. Therefore, the relationship between the amount of the output signal of the photosensor 308 and the fluctuation in the SD distance becomes as shown in FIG. 5(*a*). Incidentally, the zero voltage point in FIG. 5, which shows the fluctuation in the SD distance, corresponds to the average distance between the charging sleeve and photosensitive drum. The combination of the reflective photosensor 308 described above, and the white ring 306 (including black line 307) make up the means for detecting the rotational phase of the charging sleeve 32. That is, the fluctuation in the SD distance of the downstream charging sleeve 32, in other words, the changes in the position of a given point on the peripheral surface of the downstream charging sleeve 32, which is caused by the rotation of the downstream charging sleeve 32, can be detected by this "phase detecting means".

<Relationship Between Sd Distance and Nonuniformity in Potential Level of Photosensitive Drum>

The extent of the fluctuation of the SD distance (changes in position of peripheral surface of the charging sleeve relative to peripheral surface of photosensitive drum), which occurs while the peripheral surface of the photosensitive drum is charged, can be grasped by the above-described measuring method. Thus, the relationship between the SD distance and the potential to which the peripheral surface of the photosensitive drum is charged, can be grasped by comparing the changes in the SD distance measured as described above, and the data which shows the changes in the potential level to which the peripheral surface of the photosensitive drum 1 is charged. In this embodiment (and experiments which will be described next), an electrometer 8 was used as the means for detecting the surface potential level of the photosensitive drum 1 (FIG. 1). The electrometer 8 is on the downstream side of the charging apparatus 3 of the magnetic brush type in terms of the rotational direction of the photosensitive drum 1, and on the upstream side of the developing apparatus 5. The electrometer 8 is 35 mm downstream from the charging point. Therefore, the length of time it takes for a given point on the peripheral surface of the photosensitive drum 1 to move from the charging point to the position of the electrometer 8 has to be taken into consideration. In this experiment, the process speed was 300 (mm/sec), and therefore, the changes which occur to the potential level to which the peripheral surface of the photosensitive drum 1 is charged, in 35/300 (sec) have to be taken into consideration.

The objective of this experiment was to study the effect of the changes in the SD distance of the downstream charging sleeve upon the potential level to which the peripheral surface of the photosensitive drum 1 is charged. The image forming apparatus used in this experiment was the same in structure as the image forming apparatus in this embodiment. To the upstream charging sleeve, no voltage was applied. To the downstream charging sleeve, a combination of a DC voltage which was −600 V, and an AC voltage which is rectangular in waveform, and 300 V in peak-to-peak voltage, was applied. FIG. 5(*b*) shows the relationship between the changes in the SD distance and the changes in the potential level to which the peripheral surface of the photosensitive drum 1 was charged.

Referring to FIG. 5(*b*), the pattern of the changes in the potential level to which the peripheral surface of the photosensitive drum 1 was charged is cyclical, and its cyclicity coincides with the rotational cycle of the downstream charging sleeve. Incidentally, the changes in the potential level to which the peripheral surface of the photosensitive drum 1 was charged, and which are shown in FIG. 5(*b*), were obtained by subjecting the results of the detection by the electrometer 8 to FFT analysis, and subjecting the component of the rotational phase of the sleeve. It is evident from FIG. 5(*b*) that the smaller the SD distance, the easier for the peripheral surface of the photosensitive drum 1 to be charged, whereas the larger the SD distance, the more difficult for the peripheral surface of the photosensitive drum 1 to be charged. That is, the smaller the SD distance, the higher in performance the charging apparatus 3.

There seem to be several reasons for the occurrence of the above-described phenomenon. One is that the smaller the SD distance, the higher the density in which the magnetic particles are packed between the charging sleeve and photosensitive drum 1, and therefore, the lower the electrical resistance between the charging sleeves and photosensitive drum. Further, the smaller the SD distance, the stronger the electric field which is generated by the application of voltage to the charging sleeve, and therefore, the higher in performance the charging apparatus. In addition, the smaller the SD distance, the wider the area in which the magnetic particles are confined between the charging sleeve and photosensitive drum, in terms of the rotational direction of the photosensitive drum, and therefore, the longer the length of time the peripheral surface of the photosensitive drum is charged by the charging apparatus.

<Nonuniform Charging of Photosensitive Drum in Image Forming Apparatus Having Two Charging Sleeves>

In the case where it is only the downstream charging sleeve that voltage is applied to charge the photosensitive drum, the smaller the SD distance, the higher in performance the charging apparatus, as described above. However, in a case where the charging apparatus is provided with two or more charging sleeves as in this embodiment, it does not hold true that the smaller the SD distance, the higher in performance the charging apparatus. Thus, the present invention proposes to utilize the specific properties of the charging apparatus having two charging sleeves, to prevent a photosensitive drum from being nonuniformly charged, efficiently, that is, without requiring the downtime. Next, the relationship between the changes in the SD distance, and the changes in the potential level to which the photosensitive drum is charged, will be described based on the experiment in which the voltages applied to the upstream charging sleeve 31 and downstream charging sleeve 32 were individually altered.

<Experiment Conditions>

In order to charge the photosensitive drum 1, a combination of DC and AC voltage was applied to both the upstream and downstream charging sleeves 31 and 32. More specifically, the voltage applied to the downstream charging sleeve 32 was a combination of a DC voltage which was −600 V, and an AC voltage which was rectangular in waveform, and 300 V in peak-to-peak voltage. Further, the voltage applied to the upstream charging sleeve 31 was varied. That is, the AC voltage applied to the upstream charging sleeve was kept at 300 Vpp, whereas the DC voltage was varied in 100 V steps from −300 V to −1,000 V.

<Results of Experiment

The amount of the SD distance between the downstream charging sleeve 32 and photosensitive drum 1 while the photosensitive drum 1 was charged was obtained based on the signals from the reflective photosensor 308 as described above. Further, the surface potential level of the photosensitive drum 1 while the photosensitive drum 1 was charged was obtained by the electrometer 8. Thus, the relationship between the SD distance and the cyclical nonuniformity in potential level of the peripheral surface of the photosensitive drum 1 (which corresponds in cyclicity to the rotational cycle of upstream charging sleeve 31), which occurred while the DC voltage applied to the upstream charging sleeve 31 was increased in 100 V steps (absolute value), is shown in FIG. 6.

Figure 6:
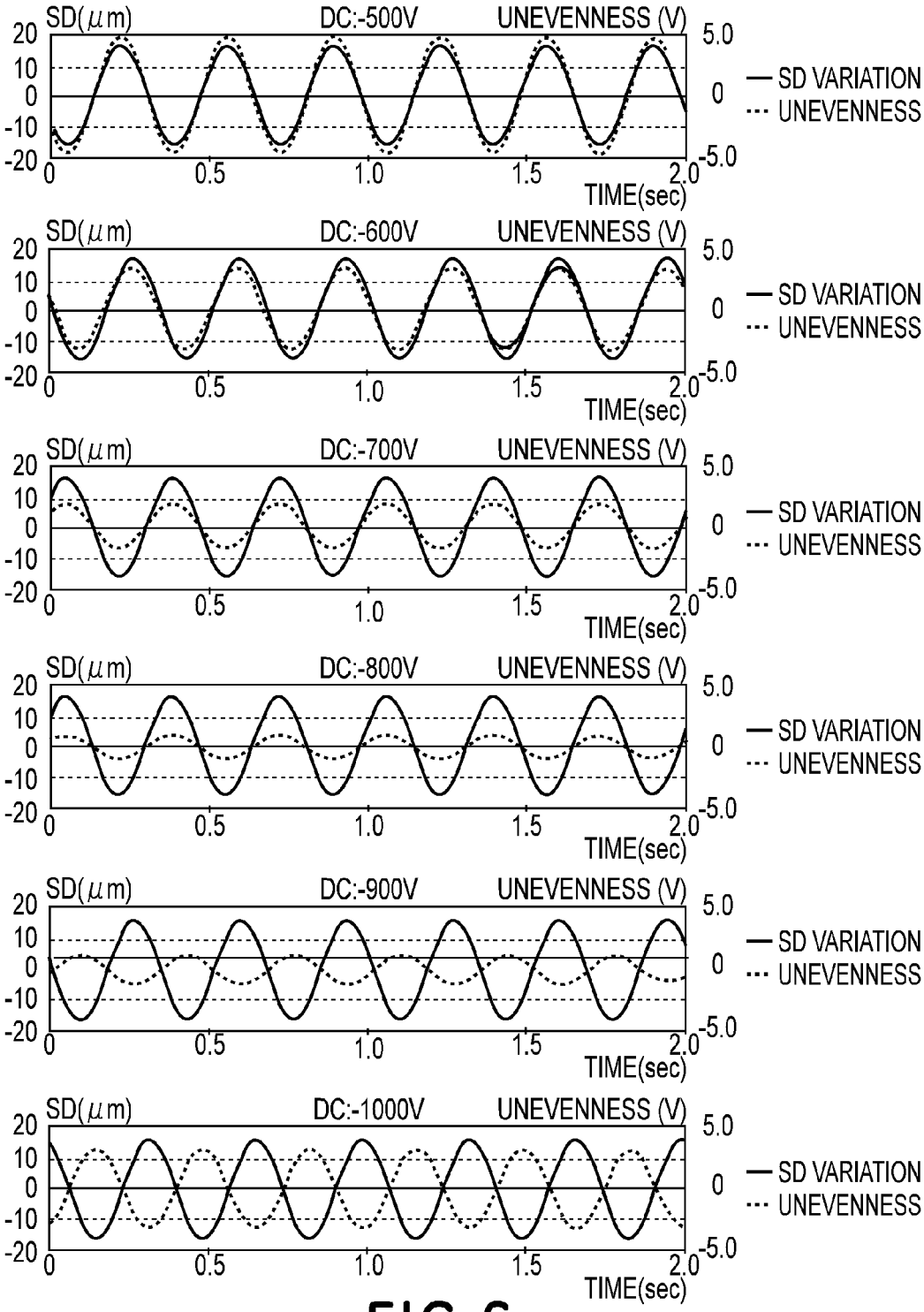
FIG. 6 is a graph which shows the relationship between the SC distance and the amount of the deviation in the potential level.
Figure 7:
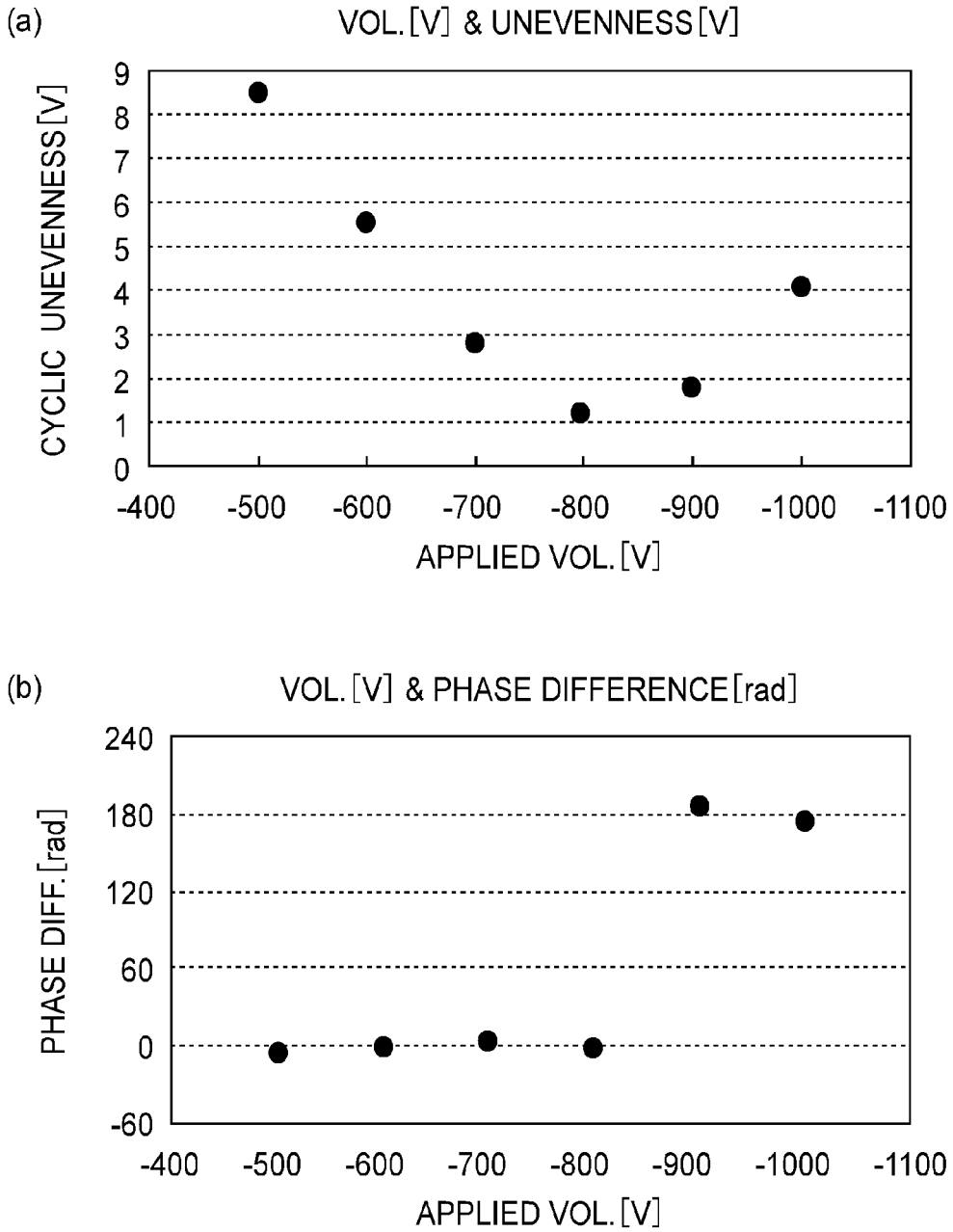
FIG. 7(*a*) is a graph which shows the relationship between the value of the applied voltage and the amount of the deviation in the potential level, and FIG. 7(*b*) is a graph which shows the relationship between the applied voltage and the "phase difference" (which will be described later).

Referring to FIG. 6, as the DC voltage was increased in absolute value, the amount of the deviation in the potential level to which the peripheral surface of the photosensitive drum 1 was charged, fell, and became the smallest when the DC voltage was −800 V. Then, as the DC voltage was further increased in absolute value, the amount of the deviation in the potential to which the peripheral surface of the photosensitive drum 1 was charged, increased. FIG. 7(*a*) shows the relationship between the DC voltage and the magnitude of the resultant deviation in the potential level to which the peripheral surface of the photosensitive drum 1 was charged. FIG. 7(*a*) helps to clearly understand the relationship between the DC voltage and the amount of the deviation in the potential level to which the peripheral surface of the photosensitive drum 1 was charged.

Referring again to FIG. 6, paying attention to the relationship between the deviation in the potential level to which the peripheral surface of the photosensitive member 1 was charged and the SD distance reveals that when the DC voltage was between −500 V and −800 V, the smaller the SD distance, the more satisfactory (the smaller, the deviation in the potential level) the charge, whereas when the DC voltage was −900 V or less, the smaller the SD distance, the less satisfactory (the larger, the deviation in potential level) the charge. That is, the cyclicity of the deviation in the potential level to which the peripheral surface of the photosensitive drum 1 was charged, became reverse in phase to the cyclicity of the change in the SD distance (phase which shows positional change of given point on peripheral surface of photosensitive drum 1, which is attributable to rotation of photosensitive drum 1), when the DC voltage was at −900 V. The changes in the "phase difference" are shown in FIG. 7(*b*), in which the "phase difference" is zero at the point in time at which the SD distance is largest (when signal is outputted from reflective photosensor 308) coincides with the point in time at which the potential level to which the peripheral surface of the photosensitive drum 1 is charged is lowest. In other words, that the "phase difference" is zero means that the difference is zero between the rotational phase of the magnetic particle bearing second member, at which the peripheral surface of the magnetic particle bearing second member and the peripheral surface of the image bearing member is largest, and the rotational phase of the magnetic particle bearing member second member, at which the potential level to which the peripheral surface of the image bearing member is charged is smallest in absolute value.

Next, the relationship between the value of the DC voltage applied to the upstream charging sleeve 31 (which hereafter will be referred to as "upstream DC") and the amount of the deviation in the potential level to which the peripheral surface of the photosensitive drum 1 was charged is examined.

<Case Where Upstream DC Voltage was −400 V>

Figure 8:
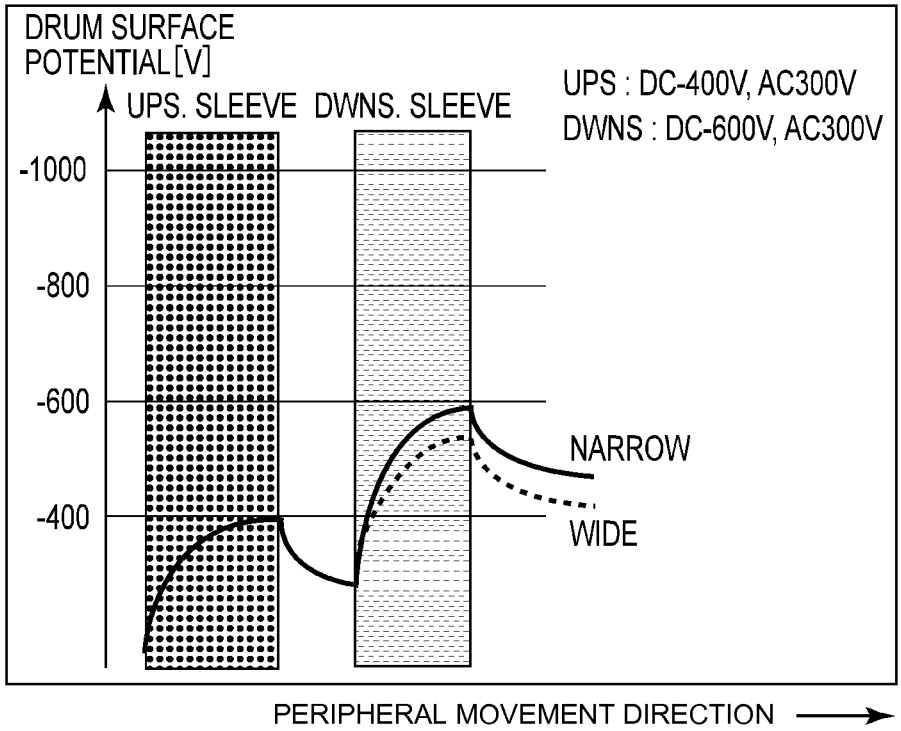
FIG. 8 is a schematic drawing which shows the changes in the potential level to which the peripheral surface of the image bearing member was charged when the upstream DC voltage was 400 V.

Next, the amount of the deviation in potential level to which the peripheral surface of the photosensitive drum 1 was charged, which occurred when the upstream DC voltage was −400 V and the downstream DC voltage was −600 V, is examined. Immediately before a given point on the peripheral surface of the photosensitive drum 1 arrived at the downstream charging sleeve 31, the surface potential level of the given point was no less than −400 V. Since −600 V of DC voltage was being applied to the downstream charging sleeve 32, the downstream charging sleeve 32 provided the photosensitive drum 1 with negative charge. During this period, when the SD distance was large, the charging apparatus was low in performance, and therefore, the amount of charge given to the photosensitive drum 1 was small, whereas when the SD distance is small, the charging apparatus is higher in performance, and therefore, the amount by which charge was given to the photosensitive drum 1 was large. FIG. 8 is a schematic drawing which shows the changes in the potential level to which the peripheral surface of the photosensitive drum 1 was charged. In FIG. 8, the vertical axis stands for the surface potential level of the photosensitive drum 1 at the charging point, and horizontal axis stands for the position of the given point on the peripheral surface of the photosensitive drum 1 (this arrangement applies FIGS. 9-11 as well). The relationship seen in FIG. 8 never changes as long as the downstream charging sleeve 32 provides the photosensitive drum with negative charge.

<Case Where Upstream DC Voltage was −1,000 V>

Figure 9:
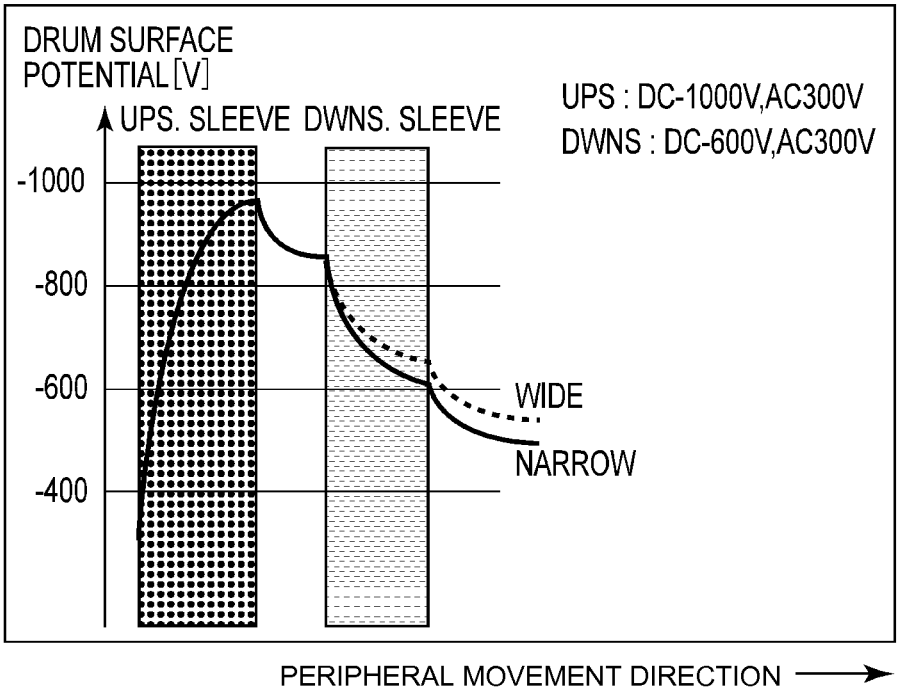
FIG. 9 is a schematic drawing which shows the changes in the potential level to which the peripheral surface of the image bearing member was charged when the upstream DC voltage was 1,000 V.

Next, the amount of the deviation in the potential level to which the peripheral surface of the photosensitive drum 1 was charged, which occurred when the upstream and downstream DC voltages were −800 V and −600 V, respectively, is examined. With this voltage setting, the surface potential level of a given point on the peripheral surface of the photosensitive drum 1 immediately before the arrival of the point at the downstream charging sleeve 32 was roughly −850 V, in consideration of the dark decay (pre-exposure attenuation of the electric charge). Since the downstream charging sleeve 32 was being supplied with, −600 V of DC voltage, the downstream charging sleeve 32 functions as a charging means for removing the negative charge from the peripheral surface of the photosensitive drum 1. Since the larger the SD distance, the lower in performance the charging apparatus, and therefore, the smaller the amount by which charge was removed from the peripheral surface of the photosensitive drum 1. Further, the smaller the SD distance, the higher in performance the charging apparatus, and therefore, the greater the amount by which charge was removed from the peripheral surface of the photosensitive drum 1. In other words, the smaller the SD distance, the greater the amount by which charge was removed from the peripheral surface of the photosensitive drum 1. Therefore, the amount by which the given point of the peripheral surface of the photosensitive drum 1 was given electric charge at the charging point when the SD was small, was smaller than the amount by which the peripheral surface of the photosensitive drum 1 was given electric charge at the charging point when the SD distance was larger. FIG. 9 is a schematic drawing for showing the changes in the potential level to which the peripheral surface of the photosensitive drum 1 was charged.

As is evident from FIGS. 8 and 9, the relationship between the changes in the SD distance and the amount by which the peripheral surface of the photosensitive drum 1 was charged when the upstream DC was −400 V is opposite to the relationship between the changes in the SD distance and the amount by which the peripheral surface of the photosensitive drum 1 was charged when the upstream DC voltage was −1,000 V. That is, when the upstream DC voltage was −400 V is opposite in the phase of the cyclical deviation in the potential level to which the peripheral surface of the photosensitive drum 1 was charged, to when the upstream DC voltage was −1,000 V. It is evident from these results that the cyclicity of the deviation in the potential level to which the peripheral surface of the photosensitive drum 1 is charged, is opposite in phase to the cyclical change in the SD distance.

<Case Where Upstream DC Voltage was −800 V>

Next, the examination of the amount of the deviation in the potential level to which the peripheral surface of the photosensitive drum 1 was charged, which resulted when the upstream and downstream DC voltages were −800 V and −600 V, respectively, is discussed. With this voltage setting, the surface potential level of a given point on the peripheral surface of the photosensitive drum 1 immediately before the arrival of the point at the downstream charging sleeve 32 was roughly −700 V, in consideration of the dark decay (pre-exposure attenuation of electric charge). Since the downstream charging sleeve 32 was being supplied with −600 V of DC voltage, the downstream charging sleeve 32 functions as a charging means for removing the negative charge from the peripheral surface of the photosensitive drum 1. In consideration of the voltage setup in which the upstream DC voltage was −1,000 V, it is reasonable to think that the smaller the SD distance, the smaller the amount by which the peripheral surface of the photosensitive drum 1 is charged. However, as will be evident from FIG. 6, the smaller the SD distance, the larger the amount by which the peripheral surface of the photosensitive drum 1 was charged. Next, the reason for the occurrence of this phenomenon is described with reference to the results of the experiment studied by the inventors of the present invention.

<Reason Why Phase Difference Does not Reverse When Upstream DC was −800 V>

Generally speaking, in order to erase the optical memory resulting from the previous exposure, a photosensitive member of the amorphous silicon type is exposed immediately before it is exposed. In this embodiment, the image forming apparatus is provided with two preparatory exposing means. Thus, there are residual photo-carriers in the photosensitive member of the amorphous silicon type. There are also thermal carriers resulting from heat. With the presence of these carriers therein, a photosensitive member of the amorphous silicon type is greater in the amount by which it lowers in potential level after the charging of the photosensitive member than an organic photosensitive member. Based on this property of a photosensitive member of the amorphous silicon type, the following may be derived.

Even if two photosensitive drums are the same in the amount of surface charge immediately after they are charged, but, are different in the amount of the residual photo-carrier and/or thermal carrier, they sometimes become different in the amount of the dark decay (amount by which their charge attenuate prior to exposure), being therefore, different in the amount of the charge they have at the position of the electrometer 8. If the point in time when a given point of the peripheral surface of the photosensitive drum 1 is at the charging point coincides with the point in time when the charging apparatus 3 is higher in performance, the amount by which the carrier in the photosensitive film (layer) of the photosensitive drum 1 is removed is greater than the otherwise, and therefore, the amount by which the charge on the peripheral surface of the photosensitive drum 1 reduces is small. On the other hand, if the point in time when a given point of peripheral surface of the photosensitive drum 1 is at the charging point coincides with the point in time when the charging apparatus 3 is lower in performance, the amount by which the carrier is removed is smaller than otherwise, and therefore, the amount by which the charge of the peripheral surface of the photosensitive drum 1 attenuates is larger. That is, the amount of the dark decay (amount by which charge of the peripheral surface of the photosensitive drum 1 attenuates before the exposure) is affected by the amount by which the carrier in the film is removed, which in turn results in the deviation in the potential level to which the peripheral surface of the photosensitive drum 1 is charged. Hereafter, the deviation in the potential level to which the peripheral surface of the photosensitive drum 1 is charged, which is attributable to the dark decay (attenuation of surface charge of photosensitive drum 1 prior to image formation exposure) will be referred to as "dark decay nonuniformity".

Figure 10:
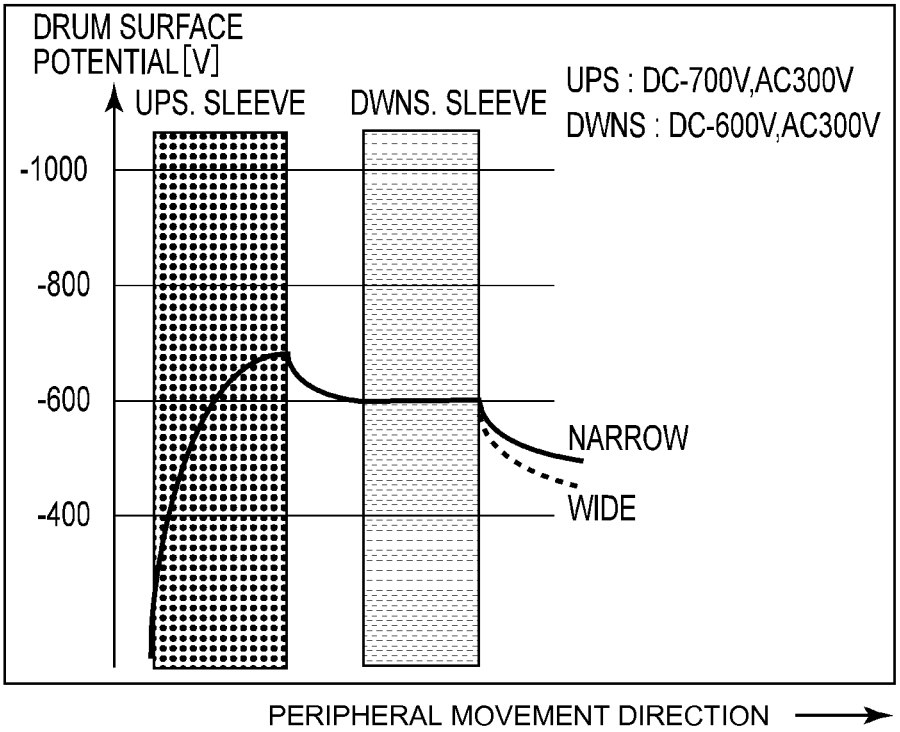
FIG. 10 is a schematic drawing which shows the changes in the potential level to which the peripheral surface of the image bearing member was charged when the upstream DC voltage was 700 V.

Next, this "nonuniformity" is described with reference to a case when −700 V of DC voltage was applied to the upstream charging sleeve 32. In this case, the surface potential level of a given point on the photosensitive drum 1 immediately before the given point enters between the downstream charging sleeve 32 and photosensitive drum 1 is roughly −600 V. Since the DC voltage being applied to the downstream charging sleeve 32 is −600 V, the charging apparatus neither charges nor discharges the peripheral surface of the photosensitive drum 1. In reality, however, the peripheral surface of the photosensitive drum 1 was nonuniformly charged as shown in FIG. 6. Further, the relationship in phase between the cyclicity of the changes in the SD distance and the cyclicity in the pattern of the nonuniformity in potential level of the peripheral surface of the photosensitive drum 1 when the upstream DC was −700 V was the same as that when the upstream DC was −400 V. Thus, it may be thought that this nonuniformity in the surface potential level is attributable to the amount by which the charge given to the peripheral surface of the photosensitive drum 1 was removed by the carrier in the film. FIG. 10 is a schematic drawing for showing how the peripheral surface of the photosensitive drum 1 was nonuniformly charged when the upstream DC voltage was −700 V.

Figure 11:
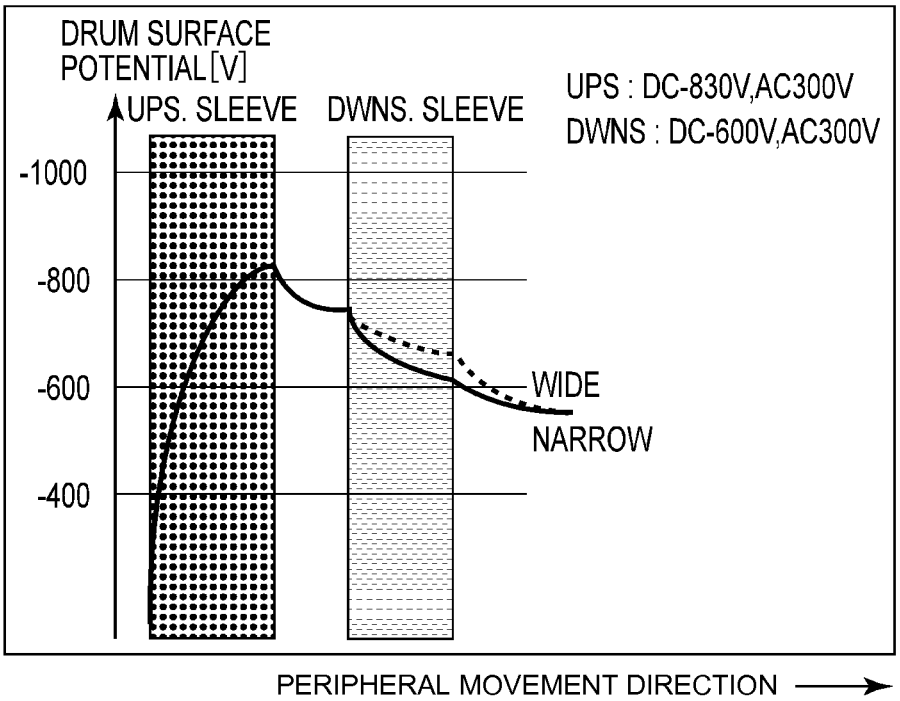
FIG. 11 is a schematic drawing which shows the changes in the potential level to which the peripheral surface of the image bearing member was charged when the upstream DC voltage was 800 V.

In comparison, when the upstream DC voltage was −800 V, the downstream charging sleeve removed the surface charge of the photosensitive drum 1. However, the relationship in phase between the cyclic fluctuation in the SD distance and the cyclicity in the amount of the deviation in the potential level to which the peripheral surface of the photosensitive drum 1 was charged did not change. Thus, it is reasonable to think that this occurred because the effect of the carrier in the film upon the amount of the deviation in potential level to which the peripheral surface of the photosensitive drum 1 was charged was greater than the effect of the removal of the surface charge of the photosensitive drum 1 by the downstream charging sleeve 32. As the upstream DC voltage was increased in absolute value, the amount of the deviation in potential level to which the peripheral surface of the photosensitive drum 1 was charged, which resulted from the "dark decay" became equal to the amount of the deviation in potential level to which the peripheral surface of the photosensitive drum 1 was charged, which resulted from the removal of the surface charge of the photosensitive drum 1 by the downstream charging sleeve 32, making smallest the overall amount of the deviation in potential level to which the peripheral surface of the photosensitive drum 1 was charged. It is predictable from FIG. 6 which shows the relationship between the amount of the deviation in the potential level to which the peripheral surface of the photosensitive drum 1 was charged and the voltage applied to the upstream charging sleeve 31 that when the upstream DC voltage was in the range of −830 V--840 V, the peripheral surface of the photosensitive drum 1 was charged with the smallest amount of the deviation in potential level. FIG. 11 is a schematic drawing for showing how the peripheral surface of the photosensitive drum 1 was charged with smallest amount of the deviation in potential level because the effect of the carrier in the film upon the potential level to which the peripheral surface of the photosensitive drum 1 was charged, was canceled by the effect of the downstream DC voltage upon the potential level to which the peripheral surface of the photosensitive drum 1 was charged.

Increasing the upstream DC voltage in absolute value to a level higher than the above-mentioned range (−830 V--840V) makes the amount of the deviation in the potential level to which the peripheral surface of the photosensitive drum is charged, which is attributable to the removal of the surface charge of the photosensitive drum 1 by the downstream charging sleeve 32 greater than the amount by which the surface charge was cancelled by the carrier in the film. Thus, the cyclical change in the amount of the deviation in the potential level to which the peripheral surface of the photosensitive drum 1 is charged becomes reverse in phase to the cyclical change in the SD distance. Thus, as the upstream DC voltage is further increased in absolute value, the deviation in the potential level to which the peripheral surface of the photosensitive drum, which is attributable to the removal of charge from the peripheral surface of the photosensitive drum 1 by the downstream charging sleeve 32 becomes greater than the effect of the SD distance upon the potential level to which the peripheral surface of the photosensitive drum 1 is charged.

<1-4: Method for Reducing Deviation in Potential Level to Which Peripheral Surface of Photosensitive Drum is Charged>

Taking into consideration what were described above, it may be concluded that it is when the cyclicity in the deviation in potential to which the peripheral surface is charged reverses in phase that the amount of the deviation becomes smallest. Therefore, what has to be done to make smallest the amount of the deviation in potential level to which the peripheral surface of the photosensitive drum 1 is charged is to detect the phase of the cyclical change in the SD distance (change in position of given point on peripheral surface of upstream charging sleeve attributable to rotation of upstream charging sleeve), and the phase of the cyclical change in the amount of the deviation in potential level to which the peripheral surface of the photosensitive drum 1 is charged, and determine whether it is the upstream DC voltage or downstream DC voltage that is to be increased or decreased. More specifically, what has to be done is to control the voltage to be applied to each magnetic particle bearing member, in response to the difference in terms of the rotational phase of the magnetic particle bearing second member between when the distance between the peripheral surface of the magnetic particle bearing second member and the peripheral surface of the image bearing member is largest, and when a given point of the peripheral surface of the photosensitive drum is charged to the highest potential level (in absolute value) in the charging point. For example, when the upstream and downstream DC voltages are both −600 V, the downstream charging sleeve 32 functions as charging means; it does not function as discharging means. That is, when the upstream and downstream DC voltages are equal in value, the phase reversal does not occur. Therefore, the phase difference at this point in time can be used as the referential point for determining whether or not the phase reversal has occurred. Incidentally, whether or not the phase reversal has occurred is determined based on whether or not the phase difference is in a present range. That is, as long as the phase difference is within a preset range, it is determined that the phase reversal did not occur. On other hand, if the phase difference falls outside the preset range, it is determined that the phase reversal occurred.

For example, assuming that V is applied as the upstream DC voltage, if the phase difference did not deviate from the referential value, the resultant nonuniformity in the surface potential level of the photosensitive drum 1 means that the downstream charging sleeve did not remove charge, or that even though the downstream charging sleeve removed charge, the nonuniformity attributable to the dark decay (pre-exposure attenuation of the surface potential of the photosensitive drum) was greater than the deviation in potential level to which the photosensitive drum 1 was discharged, which was caused by the downstream charging sleeve. This means that what is necessary to reduce the amount of the deviation in the overall potential level to which the peripheral surface of the photosensitive drum 1 is charged is to increase the amount of the deviation in the potential level to which the peripheral surface of the photosensitive drum 1 is charged, which is caused by the removal of the surface charge of the photosensitive drum 1 by the downstream charging sleeve 32. In other words, all that is necessary is to increase the upstream DC voltage in absolute value and/or to reduce the downstream DC voltage in absolute value.

On the other hand, if the phase difference is greater than the preset range (it has reversed phase), it means that the nonuniformity in the surface potential level of the photosensitive drum 1, which is attributable to the downstream charging sleeve 32, was greater than that attributable to the dark decay. In this case, therefore, all that is necessary to minimize the overall amount of the deviation in the potential level to which the peripheral surface of the photosensitive drum 1 is charged, is to reduce the amount of the deviation in potential level to which the peripheral surface of the photosensitive drum 1 is charged, which is attributable to the downstream charging sleeve. In other words, all that is necessary is to reduce the upstream DC voltage in absolute value, or increase the downstream DC voltage in absolute value.

<1-5: Method for Control Charge Voltage>

Based on the principle of the "control for reducing the amount of the deviation in the potential level to which the peripheral surface of the photosensitive drum 1 is charged", the effects of the control mode in which the voltages to be applied to the upstream and downstream charging sleeves 31 and 32, one for one, are controlled were evaluated. In this embodiment, the upstream DC voltage and downstream DC voltage were controlled by the controlling apparatus 100 based on the control algorithm shown in FIG. 12. The object of this control is to ensure that the potential level of the peripheral surface of the photosensitive drum 1 is at a preset level at the position of the electrometer 8, and to minimize the amount of the deviation in the potential level to which the peripheral surface of the photosensitive drum 1 is charged. Further, in order to achieve this object, the above-mentioned algorithm was used. More specifically, the signals were processed with the use of a real-time spectrum analyzer.

With the use of a real-time spectral analyzer, the results of the detection by the reflective photosensor 308, which is a phase detecting means, and the results of the detection by the electrometer 8, which is a potential level detecting means, are continuously processed by FFT (fast Fourier transfer). Further, the difference in phase between the signal from the reflective photosensor 308 and the cyclical changes in the amount of the deviation in the potential level to which the peripheral surface of the photosensitive drum is charged, which is measured by the electrometer 8, is obtained in real time. The condition under which the above-mentioned measurements are made are 10 msec in sampling rate, and 503 msec in the length of time the measurements are made for the FFT.

The voltage to be applied to the upstream charging sleeve 31 and downstream charging sleeve 32 are continuously controlled with the use of the real-time spectral analyzer at least during the period in which the peripheral surface of the photosensitive drum 1 is charged by the two charging sleeves 31 and 32. That is, this controlling means does not require the downtime for controlling the voltages to be applied to the upstream and downstream charging sleeves 31 and 32, respectively, in order to minimize the amount of the deviation in the potential level to which the peripheral surface of the photosensitive drum 1 is charged. Therefore, this controlling method is more efficient in terms of the minimizing the amount of the deviation in the potential level to which the peripheral surface of the photosensitive drum 1 is charged. Further, this controlling method measures in real time the difference in phase between the signal from the reflective photosensor 308 and the cyclicity of the nonuniformity of the potential level of the peripheral surface of the photosensitive drum 1, and controls the voltages to be applied to charge the peripheral surface of the photosensitive drum 1 to minimize the amount of the deviation in the potential level to which the peripheral surface of the photosensitive drum 1 is charged. Therefore, there is little possibility that improper voltages are applied. Next, referring to FIG. 12, the sequence carried out in this embodiment with the use of a real-time spectral analyzer to control the voltages to be applied to the upstream and downstream charging sleeves 31 and 32 is concretely described.

<1-6: Structure of Real-time Control>

Figure 12:
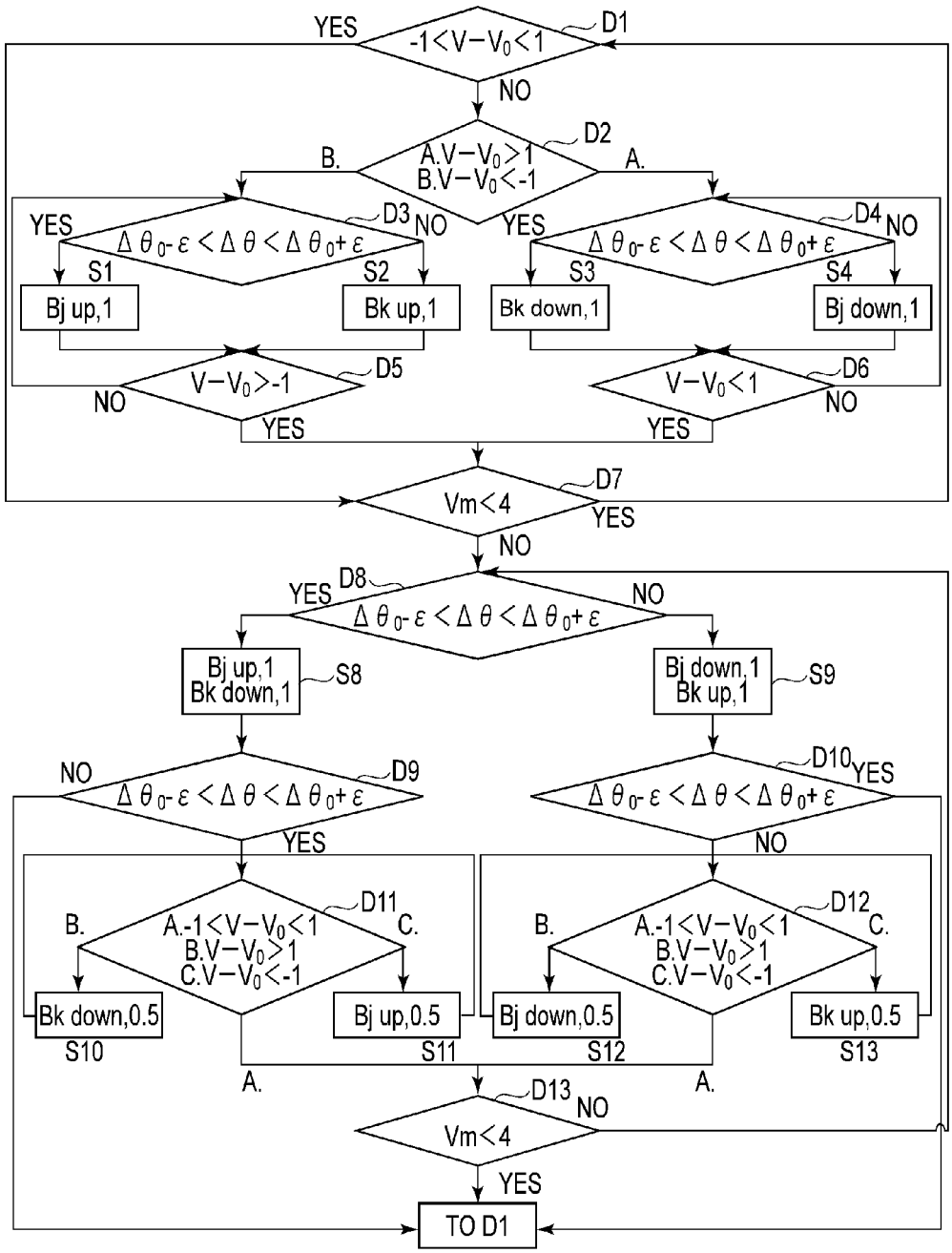
FIG. 12 is a flowchart of the voltage control sequence in the first preferred embodiment of the present invention.

In FIG. 12, and the following descriptions of the embodiments of the present invention, V0 stands for the absolute value of the preset potential level; V: two-second average of the potential levels (in absolute value) measured by the electrometer 8; $\Delta\theta 0$: initial value of the phase difference; $\Delta\theta$: measured value of phase difference; and $\in$ stands for the amount of possible error made in the determination of phase difference. Further, Bj stands for the voltage to be applied to the upstream charging sleeve 31; Bk: the voltage to be applied to the downstream charging sleeve 32; and Vm stands for the amount of cyclical deviation in the potential level to which the peripheral surface of the photosensitive drum 1 is charged by the downstream charging sleeve 32.

Further, the initial value of the phase difference is the value of the phase difference when a combination of −600 V of DC voltage, and an AC voltage which is rectangular in waveform and 300 V in peak-to-peak voltage, is applied to both the upstream and downstream charging sleeves 31 and 32, respectively. Incidentally, the control is always on while the peripheral surface of the photosensitive drum 1 is charged.

First, it is determined in Determination Step 1 whether or not the amount of the difference between the measured potential level of the peripheral surface of the photosensitive drum 1 and the preset (target) potential level of the peripheral surface of the photosensitive drum 1 is no more than 1 V. If the difference is no more than 1 V, it is determined in Determination Step 7 whether or not the amount of the deviation in potential level attributable to the rotational cycle of the sleeves is no more than 4 V. If the amount is no more than 4 V in Determination Step 7, no action is taken, and the control returns to Determination Step 1. If the amount is no less than 4 V, the control proceeds to Determination Step 8.

Further, if the difference between the measured potential level and the target potential level is no less than 1 V in Determination Step 1, the control advances to Determination Step 2, in which it is determined whether or not the peripheral surface of the photosensitive drum 1 has an excessive or insufficient amount of charge. If the amount of charge is insufficient, Determination Step 3 is taken, in which it is determined whether or not the phase reversal has occurred (it is determined whether or not phase difference is within preset range). "∈" in Determination Step 3 is a term which shows the amount of the possible error in the phase determination, and indicates the value of the above-mentioned "preset range". ∈ is affected in value by various factors, such as measurement errors, magnetic particle fluidity, etc. Based on the knowledge of the inventor of the present invention, it is possible to deal with these variable factors, as long as is 45° of width is available. That is, the "preset range" used as the reference for determining whether or not the phase reversal has occurred has only to be no more than 40 degrees. Incidentally, in this embodiment, ∈=15°.

If it is determined in Determination Step 3 that the deviation in the potential level to which the peripheral surface of the photosensitive drum 1 is charged, has reversed in phase, the control proceeds in YES direction, and carries out Processing Step 1, that is, "Bjup1", which means to increase by 1 V the DC component (upstream DC voltage) to be applied to the upstream charging sleeve 31. In Processing Step 1, the overall amount of the deviation in the potential level to which the peripheral surface of the photosensitive drum 1 is charged, is reduced by reducing the amount of the deviation in the potential level to which the peripheral surface of the photosensitive drum 1 is charged, or increasing the amount of the deviation in potential level, which is attributable to the removal of the charge, while increasing in absolute value the upstream DC, that is, the DC voltage to be applied to the upstream charging sleeve 31, in order to increase the amount of the charge to be given to the peripheral surface of the photosensitive drum 1.

If it is determined in Determination Step 3 that the cyclicity in the amount of the deviation in the potential level to which the peripheral surface of the photosensitive drum is charged has reversed in phase, the control proceeds in NO direction, and carries out Processing step 2, that is, "Bku1", which means to increase by 1 V in absolute value, the DC component (downstream DC) to be applied to the downstream charging sleeve 32 is carried out. In Processing step 2, the overall amount of the deviation in the potential level to which the peripheral surface of the photosensitive drum 1 is charged is reduced by reducing the upstream DC voltage, that is, the voltage to be applied to the upstream charging sleeve 32, in order to reduce the amount by which the peripheral surface of the photosensitive drum 1 is charged, or to reduce the amount of the deviation in potential level, which is attributable to the removal of the charge.

If it is determined in Determination Step 2 that the peripheral surface of the photosensitive drum 1 has an excessive amount of charge, the Determination Step 4 is taken, in which it is determined if the cyclical changes in the amount of the deviation in the potential level to which the peripheral surface of the photosensitive drum is charged, has reversed in the phase. If it has not reversed, the control proceeds in YES direction, and Processing step 3, that is, "Bkdown1" is carried out, which means that the upstream DC is reduced by 1 V in absolute value. In Processing step 3, the overall amount of the deviation in the potential level to which the peripheral surface of the photosensitive drum 1 is charged, is reduced by reducing the upstream DC voltage, that is, the voltage to be charged to the upstream charging sleeve 31, in absolute value, in order to reduce the amount of the deviation in the potential level to which the peripheral surface of the photosensitive member is charged, or increasing the amount of the deviation in the potential level, which is attributable to the removal of charge.

If it is determined in Determination Step 4 that the cyclicity in the changes in the amount of the deviation in the potential level to which the peripheral surface of the photosensitive drum is charged, has reversed in the phase, the control proceeds in NO direction, and Processing step 4, that is, "Bjdown1" is carried out, which means that the downstream DC, that is, the DC voltage to be charged to the downstream charging sleeve 32, is reduced by 1 V in absolute value. In Processing step 4, the overall amount of the deviation in the potential level to which the peripheral surface of the photosensitive drum 1 is charged, is reduced by reducing the downstream DC voltage, that is, the voltage to be applied to the downstream charging sleeve 32, in order to reduce the amount of the deviation in potential level, which is attributable to the removal of charge, while reducing the amount by which the peripheral surface of the photosensitive drum is charged.

After the completion of one of Processing step 1-4, it is determined in Determination Step 5 or 6 whether the difference between the measured potential level and the target potential level is no more than 1 V. If it is no more than 1 V, the control returns to Determination Step 3 or 4, respectively. If it is no more than 1 V, the control proceeds to Determination Step 7, in which it is determined whether or not the amount of the nonuniformity is no more than 4 V. If it is no more than 4 V, the control returns to Determination Step 1. If it is no less than 4 V, the control proceeds to Determination Step 8. Up to this point in the control sequence, if the difference between the measured potential level and target potential level is no less than 1 V, the control is such that if the difference between the measured potential level and target potential level is no less than 1 V, the potential level to which the peripheral surface of the photosensitive drum is charged is made to converge to the preset level, by reducing the amount of the deviation in the potential level to which the peripheral surface of the photosensitive drum is charged.

On the other hand, the control based on the determination made in Determination Step 8 and thereafter, is such a control that is for optimally setting the potential level when the amount of the difference between the measured potential level and the target potential level is no more than 1 V, but the deviation in the potential level to which the peripheral surface of the photosensitive drum is charged has not been optimized. That is, in this case, the control is executed to reduce the amount of the deviation in the potential level, while maintaining the target potential level.

First, it is determined in Determination Step 8 whether or not the cyclicity in the changes in the amount of the deviation in the potential level has reversed in phase. If it has not reversed, the control proceeds in YES direction, and Process 8, that is, "Bjup1 Bkdown1" is carried out, which is a process for increasing the upstream DC by 1 V in absolute value, and reducing the downstream DC by 1 V in absolute value. This process can make it possible to lower the overall amount of the deviation of the potential level to which the peripheral surface of the photosensitive drum 1 is charged, by increasing the amount of the deviation in potential level, which is attributable to the removal of charge, without causing the charge voltages to substantially deviate from the preset value.

If it is determined in Determination Step 8 that the cyclicity in the charges in the amount of the deviation in potential level has reversed in phase, the control moves in NO direction, and Processing step 9, in which "Bkdown1 Bkup1" is carried out, which is for reducing the upstream DC by 1 V in absolute value, and increasing the downstream DC by 1 V in absolute value. With the execution of this processing step, it is possible to reduce the overall amount of the deviation in the potential level to which the peripheral surface of the photosensitive drum 1 is charged, by reducing the amount of the deviation in the potential level, which is attributable to the removal of charge, without making the charge voltage substantially deviate from the preset value.

After the completion of one of these processing steps, it is determined in Determination Step 9 or 10 whether or not the cyclicity in the changes in the amount of the deviation in the potential level to which the peripheral surface of the photosensitive drum is charged has reversed in phase. Here, it is determined whether or not the alteration of the downstream DC voltage caused the cyclicity in the amount of the deviation in the potential level, to change in phase. If it is determined that the change has occurred, the value to which the charge voltage applied to the charging sleeve is the value at which the cyclicity in the changes in the amount of the deviation in the potential level to which the peripheral surface of the photosensitive drum is charged changed in phase. That is, the amount of the deviation in the potential level to which the peripheral surface of the photosensitive drum 1 is charged became smallest, ending the sequence, and then, the control returns to Determination Step 1.

If it is determined in Determination Step 9 that the cyclicity has not reversed in phase, the control proceeds to Determination Step 11, in which it is determined whether or not the alteration in the downstream DC voltage caused the peripheral surface of the photosensitive drum 1 to change to a potential level (measured potential level) different from the preset potential level. If the amount of charge of the peripheral surface of photosensitive drum 1 is excessive, Processing Step 10 is taken, in which "Bkdown0.5" is carried out, whereby the DC voltage to be applied to the downstream charging sleeve 32 is reduced by 0.5 V in absolute value.

On the other hand, if the amount of charge on the peripheral surface of the photosensitive drum 1 is insufficient, Processing Step 11 is taken, in which "Bjup0.5" is carried out, whereby the voltage to be applied to the upstream charging sleeve 31 is increased by 0.5 V in absolute value. After one of these Processing steps is completed, Determination Step 11 is resumed. The above-described steps are repeated until the amount of the difference between the measured potential level and the preset potential level becomes no more than 1 V. As the amount of the difference becomes no more than 1 V, it is determined in Determination Step 13 whether or not the amount of the fluctuation in potential level is no more than 4 V. If the amount of the fluctuation in potential level is no more than 4 V, Determination Step 1 is resumed. If it is not, Determination Step 8 is resumed to repeat the above-described steps which follows the Determination Step 8. If it is determined in Determination Step 10 that the cyclicity in the amount of the deviation in potential level to which the peripheral surface of the photosensitive drum has not changed in phase, Determination Step 12 is taken, in which it is determined whether or not the alternation of the upstream DC and downstream DC voltage has caused the potential level of the peripheral surface of the photosensitive drum 1 to change to a potential level (measured potential level) which is different from the preset one. If the amount of charge on the peripheral surface of the photosensitive drum 1 is excessive, Processing Step 12 is taken, in which "Bjown0.5" is carried out, whereby the DC voltage to be applied to the downstream charging sleeve 32 is reduced by 0.5 V in absolute value. If the amount of charge is insufficient, Processing Step 13 is taken, in which "Bkup0.5" is carried out, whereby the voltage to be applied to the downstream charging sleeve 32 is increased by 0.5 V in absolute value.

As described above, in Determination Step 8 and the steps thereafter, the voltages to be applied to the upstream and downstream charging sleeves 31 and 32 are controlled to reduce the amount of the deviation in the potential level to which the peripheral surface of the photosensitive drum 1 is charged, to no more than 4 V, or to reverse in phase the cyclicity in the changes in the amount of the deviation in the potential level, while ensuring the peripheral surface of the photosensitive drum 1 is charged to the preset potential level. In this embodiment, the upstream and downstream DC voltages are adjusted in absolute value, based on the detected phase difference. The absolute value of the potential level to which the peripheral surface of the photosensitive drum 1 is charged can be increased or reduced by altering the upstream and downstream DC voltages. That is, the potential level to which the peripheral surface of the photosensitive drum 1 is charged can be increased in absolute value by increasing the DC voltages. Conversely, the potential level to which the peripheral surface of the photosensitive drum 1 is charged can be reduced in absolute value by reducing the DC voltages. As will be evident from the description of this embodiment present invention, the charging apparatus can be efficiently reduced in the amount of the deviation in the potential level to which the peripheral surface of the photosensitive drum 1 is charged, by altering how the upstream and downstream DC voltages are controlled, based on the phase difference.

<1-7: Test Results>

Figure 13:
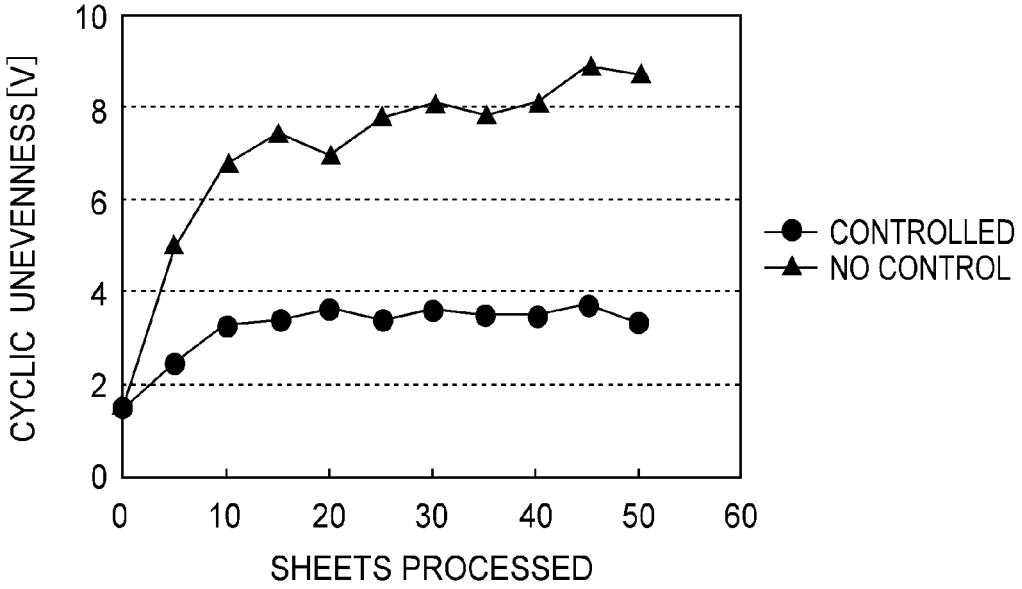
FIGS. 13(*a*) and 13(*b*) are graphs which show the relationship between the cumulative number of copies made by an image forming apparatus, and the change in the amount of the deviation in the potential level to which the peripheral surface of the image bearing member was charged.
Figure 13:
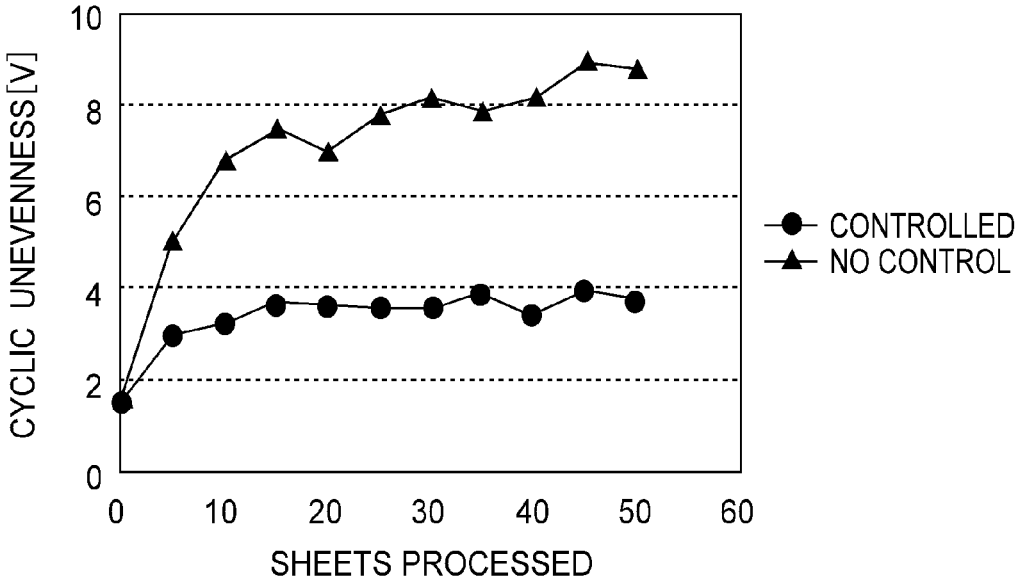

The results of the charging apparatus (image forming apparatus) endurance tests carried out under the above-described real-time control are shown in FIG. 13(*a*). However, the amount of the deviation in the potential level to which the peripheral surface of the photosensitive drum 1 was charged, which is shown in this graph, is the amount of the deviation in the potential level, which is attributable to the rotational cycle of the sleeves. Referring to FIG. 13(*a*), when the drum charging voltages were not controlled, the charging apparatus quickly became nonuniform in the potential level to which the peripheral surface of the photosensitive drum 1 was charged. More specifically, when the 5,000th and 50,000 copies were outputted, the amounts of the deviation in the potential level to which the peripheral surface of the photosensitive drum 1 was charged were 5 V and 9 V, respectively. In comparison, in the case of the charging apparatus (image forming apparatus) in accordance with the present invention, the amount of the deviation in the potential level was no more than 4 V when 50,000th copy was outputted, proving that the present invention can reduce the charging apparatus in the amount of the deviation in the potential level to which the peripheral surface of the photosensitive drum 1 is charged.

As will be evident from the above description of this embodiment of the present invention, the present invention can efficiently minimize an image forming apparatus having multiple charging sleeves, in the amount of the deviation in the potential level to which the peripheral surface of the photosensitive drum of the apparatus is charged, by optimizing the voltages to be applied to the charging sleeves.

Embodiment 2

As described above, all that is necessary to reduce the amount of the deviation in the potential level to which the peripheral surface of the photosensitive drum 1 is charged, is to control the charging apparatus in real time to set the upstream and downstream DC voltages to the values at which the phase difference reverses. In the first embodiment, therefore, the charge voltage to be applied to the upstream and downstream charging sleeves 31 and 32, one for one, were controlled in their DC components.

However, the means for altering a charging apparatus in performance does not need to be limited to the means which controls the charge voltages in their DC component. For example, the voltages to be applied to the upstream and downstream charging sleeves 31 and 32, one for one, may be controlled in their AC component. In this embodiment, therefore, the charging apparatus is controlled in the AC component (upstream AC) to be applied to the upstream charging sleeve 31, and the AC component (downstream AC) to be applied to the downstream charging sleeve 32. Incidentally, the image forming apparatus in this embodiment is the same in structure as that in the first embodiment, and therefore, is not described here.

The sequence, in this embodiment, for controlling the charge voltages is the same as that shown in FIG. 12. In this embodiment, the steps in which the upstream and downstream DC voltages are controlled, are replaced with steps in which the upstream and downstream AC voltages are controlled to obtain the same effects as those obtained by the first embodiment. More concretely, for example, in Processing Step 1 in the first embodiment, "Bjup1" is carried out. In comparison, in Processing Step 1 in this embodiment, "upstream AC voltage is increased in amplitude by 1 V in absolute value". The potential level to which the peripheral surface of the photosensitive drum 1 is charged can be raised or lowered by changing the AC voltage to be applied to the charging sleeve, as described above. That is, the potential level to which the peripheral surface of the photosensitive drum 1 is charged can be raised in absolute value by increasing in amplitude the AC voltage to be applied to the charging sleeve. Conversely, the potential level to which the peripheral surface of the photosensitive drum 1 is charged can be lowered in absolute value by decreasing in amplitude the AC voltage applied to the charging sleeve.

FIG. 13(*b*) shows the results of the endurance test of the charging apparatus in this embodiment, in which the voltages to be applied to the charging sleeves were controlled. When the charging voltages were not controlled, the charging apparatus quickly became noticeably nonuniform in the potential level at which the peripheral surface of the photosensitive drum 1 was charged. More specifically, when the 5,000th and 50,000 copies were outputted, the amount of the deviation in the potential level to which the peripheral surface of the photosensitive drum 1 was charged were 5 V and 9 V, respectively. In comparison, in the case of the charging apparatus (image forming apparatus) in accordance with the present invention, the amount of the nonuniformity was no more than 4 V when 50,000th copy was outputted, proving that the present invention can reduce the charging apparatus in the amount of the deviation in the potential level to which the peripheral surface of the photosensitive drum 1 is charged.

As will be evident from the description of this embodiment of the present invention, the present invention can efficiently minimize an image forming apparatus having multiple charging sleeves, in the amount of the deviation in the potential level to which the peripheral surface of the photosensitive drum of the apparatus is charged, by optimizing the voltages to be applied to the charging sleeves.

[Miscellanies]

In the above-described embodiments of the present invention, the image forming apparatuses were provided with two charging sleeves. However, the present invention is also compatible to any charging means having three or more charging sleeves, as long as it is the same in structure as those in the preceding embodiments, and can achieve the same effects as those achieved by the charging means in the preceding embodiments. That is, all that is necessary to obtain the same effects as those obtained by the charging means in the preceding embodiments is to detect the difference in phase between the cyclicity of the changes in the amount of the deviation in the potential level to which the surface of the image bearing member is charged, and the cyclicity of the change in the SD distance, and control the voltage to be applied to the magnetic particle bearing most downstream member, and the voltages to be applied to the magnetic particle bearing members other than the most downstream one, based on the detected difference in the phase. Incidentally, it is unnecessary for an image forming apparatus to be always operated in the above-described control mode; it may be only when images of very high quality are wanted that the apparatus is operated in the above-described control mode. Further, in the preceding embodiments, the photosensitive members were negatively chargeable. However, the present invention is also compatible with a positively chargeable photosensitive member. Needless to say, the application of the present invention to an image forming apparatus employing a positively chargeable photosensitive member yields the same effects as these described above.

Further, in the preceding embodiments, the change in the SD distance and the rotational phase of the charging sleeve were detected by a photosensor as described hereinafter. However, they can be detected by utilizing the revolution of the motor for rotating the charging sleeves. For example, the amount of the deviation in the potential level to which the peripheral surface of the photosensitive drum 1 was charged is measured by the electrometer 8 while applying a combination of −600 V of DC voltage, and an AC voltage which is rectangular in waveform and 300 V in peak-to-peak voltage, only to the downstream charging sleeve 32. In this case, the resultant amount of the deviation in the potential level to which the peripheral surface of the photosensitive drum 1 was charged is attributable to the change in the SD distance of the downstream charging sleeve 32. Thus, the cyclicity of the nonuniformity detected by the electrometer 8 may be assumed to coincide with the rotational cycle of the downstream charging sleeve 32. For example, if the surface potential level of the photosensitive drum 1 is smallest in absolute value every (5+8 n)th rotation (n: positive number) of the motor, it is reasonable to think that the downstream charging sleeve 32 rotates once every (5+8 n) rotations of the motor. Thus, it may be assumed that the point in time when the surface potential level of the photosensitive drum 1 is smallest in absolute value coincides with the point in time when the SD distance of the downstream charging sleeve 32 is the largest. Therefore, the change in the SD distance and rotational phase of the charging sleeve can be obtained by structuring the apparatus so that the signal which indicates the rotational phase of the downstream charging sleeve 32 is outputted instead of the signal which is outputted by the electrometer 8. Incidentally, in the case where the revolution of the motor is utilized, the means for detecting the motor revolution functions as the phase detecting means. Further, in the above-described embodiments, the charging apparatus (image forming apparatus) were structured so that it was only to the downstream charging sleeve 32 that the voltage was applied. However, the apparatus may be structured so that voltage is applied to both the upstream and downstream charging sleeves 31 and 32, respectively. In this case, the apparatus is structured so that the fluctuation in the surface potential level of the photosensitive drum 1, which is detected by the electrometer 8 is subjected to frequency analysis to extract only the effects of the downstream charging sleeve 32 upon the potential level to which the peripheral surface of the photosensitive drum 1 is charged.

Further, in the case where the method which takes into consideration, only the amount of the deviation in the potential level to which the peripheral surface of the photosensitive member, which is attributable to only the downstream charging sleeve 32, is used, the position of the black line 307 on the white ring 306 on the downstream charging sleeve 32 does not need to coincides with the point of the downstream charging sleeve 32, which makes the SD distance of the downstream charging sleeve 32 largest. That is, it may be any point of the white ring 306 of the downstream charging sleeve 32 that the black line 307 is drawn, and this point is used as the referential point for the rotational phase of the downstream charging sleeve 32. Then, the relationship between the black line 307 on the white ring 306 on the downstream charging sleeve 32 and the change in the SD distance of the downstream charging sleeve 32 may be deduced from the relationship between the rotational phase of the downstream charging sleeve 32, which minimize in absolute value, the amount of the deviation in the potential level to which the peripheral surface of the photosensitive drum 1 is charged, when voltage is applied to only the downstream charging sleeve 32. For example, if the deviation in potential level of the peripheral surface of the photosensitive drum 1 becomes smallest in absolute value when the rotational phase of the downstream charging sleeve 32 is 40° from the referential point on the white ring 306, it may be assumed that the SD distance of the downstream charging sleeve 32 became the largest after the elapse of a length of time equivalent to 40° of rotation of the downstream charging sleeve 32 from when the referential point on the white ring 306 is detected.

Further, in the first and second embodiments, the definition of "phase difference" was the difference between the rotational phase of the magnetic particle bearing second member, at which the distance between the peripheral surface of the magnetic particle bearing second member and the peripheral surface of the image bearing member become the largest, and the rotational phase of the magnetic particle bearing second member, at which the surface potential level of the image bearing member becomes largest in absolute value. Instead, the difference between the rotational phase of the magnetic particle bearing second member, at which the SD distance is the largest, may be detected, and the rotational phase of the magnetic particle bearing second member, at which the surface potential level of the image bearing member is largest in absolute value, may be used as the "phase difference", because even in this case, whether it is the downstream charging sleeve 32 or upstream charging sleeve 31 that is greater in the effect upon the amount of deviation in potential level of the peripheral surface of the photosensitive drum 1 can be determined from the "phase difference". In essence, all that is necessary is to control the voltages to be applied to the charging sleeves 31 and 32, based on the results of the measurement by the electrometer 8, and the results of the detection of the rotational phase of the downstream charging sleeve 32.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 231429/2009 and 215317/2010 filed Oct. 5, 2009 and Sep. 27, 2010, respectively, which are hereby incorporated by reference.

What is claimed is:

1. An image forming apparatus comprising:

a rotatable image bearing member;

charging means for charging said image bearing member, said charging means including a first magnetic particle carrying member for carrying electroconductive magnetic particles and a second magnetic particle carrying member for carrying electroconductive magnetic particles, said second magnetic particle carrying member being disposed downstream of said first magnetic particle carrying member with respect to a rotational direction of said image bearing member, wherein the magnetic particles are in contact with said image bearing member while charging said image bearing member;

latent image forming means, disposed downstream of said charging means with respect to the rotational direction of said image bearing member, for forming a latent image on said image bearing member;

potential detecting means for detecting a surface potential of said image bearing member, said potential detecting means being disposed downstream of said charging means with respect to the rotational direction of said image bearing member;

phase detecting means for detecting information relating to a rotational phase of said second magnetic particle carrying member; and control means for controlling voltages applied to said first magnetic particle carrying member and to said second magnetic particle carrying member, wherein said control means is capable of executing an operation in a control mode for controlling the voltages applied to said first magnetic particle carrying member and to said second magnetic particle carrying member, on the basis of a result of detection by said potential detecting means and a result of detection by said phase detecting means.

2. An apparatus according to claim 1, wherein the voltages applied to said first magnetic particle carrying member and said second magnetic particle carrying member include DC voltage components, and wherein said control means, when executing the control mode, controls the DC voltage components according to a phase difference determined on the basis of the result of detection by said potential detecting means and the result of detection by said phase detecting means.

3. An apparatus according to claim 1, wherein the voltages applied to said first magnetic particle carrying member and said second magnetic particle carrying member are superimposed voltages including DC voltage components and AC voltage components, and wherein said control means, when executing the control mode, controls amplitudes of the AC voltage components of the superimposed voltages according to a phase difference determined on the basis of the result of detection by said potential detecting means and the result of detection by said phase detecting means.

4. An apparatus according to claim 1, wherein said image bearing member is an amorphous silicon photosensitive member.

* * * * *